US005089824A

United States Patent [19]

Uematsu et al.

[11] Patent Number: 5,089,824

[45] Date of Patent: Feb. 18, 1992

[54] ANTENNA APPARATUS AND ATTITUDE CONTROL METHOD

[75] Inventors: Masahiro Uematsu; Tetsumi Harakawa; Ryuichi Hiratsuka, all of Otemachi; Kenji Ohmaru, Tokyo; Shigeru Yamazaki, Tokyo; Yasuhiro Ito, Tokyo; Isao Nemoto; Kazuro Kato, both of Yachiyo, all of Japan

[73] Assignees: Nippon Steel Corporation, Tokyo; Nemoto Project Industry Co., Chiba; Nippoon Hoso Kyokai, Tokyo, all of Japan

[21] Appl. No.: 336,991

[22] Filed: Apr. 11, 1989

[30] Foreign Application Priority Data

| | | | |
|---|---|---|---|
| Apr. 12, 1988 | [JP] | Japan | 63-90060 |
| Jun. 1, 1988 | [JP] | Japan | 63-135265 |
| Jun. 1, 1988 | [JP] | Japan | 63-135266 |
| Jun. 22, 1988 | [JP] | Japan | 63-154219 |

[51] Int. Cl.[5] ..... H01Q 3/00

[52] U.S. Cl. ..... 342/359; 342/75; 342/442; 343/765

[58] Field of Search ..... 343/765; 342/75, 359, 342/442

[56] References Cited

U.S. PATENT DOCUMENTS

| | | | |
|---|---|---|---|
| 2,480,829 | 9/1949 | Barrow et al. | 343/765 |
| 3,025,515 | 3/1962 | Fairbanks | 343/765 |
| 3,133,283 | 5/1964 | Glose . | |
| 3,316,548 | 4/1967 | D'Amico | 342/75 |
| 4,090,201 | 5/1978 | Whitman, Jr. | 342/75 |
| 4,346,386 | 8/1982 | Francis et al. | 343/765 |
| 4,638,320 | 1/1987 | Eggert et al. . | |
| 4,725,843 | 2/1988 | Suzuki et al. . | |

*Primary Examiner*—Mark Hellner

*Attorney, Agent, or Firm*—Sughrue, Mion, Zinn, Macpeak & Seas

[57] ABSTRACT

Attitude control is implemented by detecting the phase difference between signals received by at least two antennas and detecting the angle of deflection between the direction of arrival of radio signals and the antenna beams. By using antennas that are separately driven, within the plane of rotation in which the deflection angle is to be detected, the phase of the received signals can be shifted equivalently to when the antennas are driven as a consolidated unit. Also, when at least three antennas are used in an orthogonal arrangement for detecting the deflection angle in two directions, the antennas are divided into two groups which are individually driven. This reduces the inertia of the moving parts and enables the size and weight of the drive mechanisms to be reduced.

In addition, two orthogonal functions are used to represent the phase of the deflection angle of the direction of arrival of the radio wave and the antenna beam as a multiplicity of quadrants, and by storing these, when there is a change in the deflection angle, the sequence of change can be traced back and the control effected accordingly. This enables error to be eliminated.

14 Claims, 22 Drawing Sheets

ANTENNA APPARATUS AND ATTITUDE CONTROL METHOD

BACKGROUND OF THE INVENTION

Field of the Invention

The present invention relates to an attitude control apparatus and method, and more particularly to an antenna attitude apparatus and control method for receiving satellite broadcasts in a vehicle such as a car.

Since satellite communications first became a reality there have been moves toward receiving radio waves from satellites not only in fixed structures such as buildings but also in cars and other vehicles. A high-gain antenna, i.e., an antenna with high directionality, is required to receive the weak radio waves from a satellite. As such, when the aim is to receive satellite radio waves in a vehicle, controlling the attitude of the antenna becomes a problem that has been the subject of numerous methods and techniques that have been proposed.

One example is the antenna device for satellite communications disclosed in Japanese Patent Publication SHO 61(1986)-28244. Stated briefly, the device of the disclosure employs a communications antenna and a rate gyroscope on a flywheel type stabilizing stand to maintain the attitude of an antenna that has been initially set to the direction for receiving the transmissions.

However, high-gain antennas for receiving weak signals from satellites are relatively large and heavy, and to install them so they maintain their stability necessitates the use of a flywheel having a large inertia, i.e., a heavy flywheel, which makes them unsuitable for installing in small vehicles.

Owing to the maneuverability of small vehicles, attitude changes tend to be intensive, and to maintain the initial attitude over long periods in the face of such intensive changes of attitude requires the use of a large rate gyroscope having a large inertia, which is another reason that makes such an apparatus unsuitable for small vehicles.

SUMMARY OF THE INVENTION

The object of the present invention is to provide an antenna apparatus that ensures good communication and is also suitable for installing in a small vehicle such as a car, and an attitude control method for use with the antenna apparatus.

To attain this object, the present invention provides an antenna attitude control arrangement comprising supporting first, second and third receiving antennas so that the antennas are movable in a first direction and in a second direction that is orthogonal to the first direction while maintaining the radiation lobes of the antennas parallel, and maintaining a plane that includes the radiation lobes of the first and second receiving antennas perpendicular to a plane that includes the radiation lobes of the first and third receiving antennas, and obtaining the direction of a radio wave source from the phase difference between signals received by the first receiving antenna and signals received by the second receiving antenna and the phase difference between signals received by the first receiving antenna and signals received by the third receiving antenna.

In addition, the support means of a first antenna group that includes the first and second antennas is provided separately from the support means of a second antenna group that includes the third receiving antenna, decreasing the inertia in the first direction and reducing the size and weight of the drive mechanisms.

In accordance with this arrangement the antenna attitude is controlled by detecting shifts in the location of the radio wave source relative to the antenna, which eliminates any need for a large, heavy flywheel or large rate gyroscope.

Also, in addition to decreasing the inertia in the first direction and reducing the size and weight of the mechanisms that provide the driving force in that direction, providing separate support means for the first antenna group that includes the first and second antennas and the second antenna group that includes the third receiving antenna results in a smaller inertia even when the antennas are driven as a consolidated unit, which provides improved response to the type of intensive attitude changes that a small vehicle undergoes, thereby ensuring reliable communication.

When the first receiving antenna whose attitude is changeable in a first direction and the second receiving antenna whose attitude is changeable in a second direction that is similar to the first direction ar driven to orient them toward the radio wave source while maintaining the beams of the antennas parallel:

the phase of the signal received by the first receiving antenna is shifted by a phase corresponding to the distance between projected points obtained when a point that is substantially the beam radiation point of the first receiving antenna and a point that is substantially the beam radiation point of the second receiving antenna are projected onto a single arbitrary line that is parallel to each beam, the direction of the radio wave source is obtained and the attitude of the first and second receiving antennas is set on the basis of the phase difference between the signal received by the first receiving antenna subsequent to the shift and the signal received by the second receiving antenna.

Thus, the signals received by the separately driven first and second receiving antennas are phase-shifted and are used as the equivalent to when the antennas are driven as a consolidated unit, which enables the direction of arrival of the radio waves to be correctly detected and the attitude of each antenna to be correctly controlled. Because each antenna is driven separately, the inertia of the moving parts is reduced, which is advantageous for effecting a marked reduction in the size of the apparatus. The effect is particularly pronounced when a plane antenna is used in place of a three-dimensional antenna.

In driving the first, second and third receiving antennas whose attitudes can be changed to orientate them toward the radio wave source while maintaining the beams parallel:

the signal received from the first receiving antenna and the signal received from the second receiving antenna are multiplied together and the phase difference between the signals is extracted as a first function; the signal received by the first receiving antenna and the signal received by the second receiving antenna which has been phase-shifted 90 degrees are multiplied together and the phase difference between the signals is extracted as a second function which is orthogonal to the first function;

the phase of the angle of deflection of the beams of the first and second receiving antennas with respect to the direction of the radio wave source is divided into a multiplicity of quadrants based on the sign of the phase difference extracted as a first function and the sign of the phase difference extracted as a second function;

while monitoring changes in the phase of the angle of deflection, at least one of the phase difference extracted as a first function and the phase difference extracted as a second function is corrected on the basis of preceding phase quadrants and current phase quadrants, and the attitudes of the first and second receiving antennas are set on the basis of the corrected phase difference.

Accordingly, as the phase of the angle of deflection of the first and second antennas with respect to the radio wave source is monitored by means of quadrants that show the phase difference between the signals received by each antenna, extracted as two orthogonal functions, it facilitates retracing the direction in which the deflection angle changes. That is, the phase difference between the signals received by each antenna thus extracted is corrected on the basis of preceding and current quadrants, so that phase differences between signals received by a multiplicity of antennas can be used to eliminate pointing error when orienting the antennas toward the radio wave source.

An attitude control method for controlling the attitude of a control object by linking drive means to a control object the attitude of which can be changed, providing data indicating the target attitude and energizing the drive means using energizing data based on the provided data, comprising:

detecting first attitude data that indicate the attitude to be induced in the control object when the drive means are energized and/or first update rate data that indicate the attitude update rate, together with second attitude data indicating the actual attitude of the control object and/or second update rate data indicating the attitude update rate, and compensating the energizing data used to energize the drive means on the basis of first disturbance data obtained from the differential between the first attitude data and the second attitude data and/or second disturbance data obtained from the differential between the first update rate data and the second update rate data.

In accordance with this arrangement, disturbance data are obtained and the energizing data are compensated accordingly, eliminating the possibility that such disturbance may cause the drive means to be over- or under-energized, so stable attitude control is ensured. Particularly when the energizing data are compensated by detecting first attitude data, first update rate data, second attitude data and second update rate data and obtaining first and second disturbance data, the reliability of the attitude control stability is increased by the fact that even if one of the above cannot be used for the compensation, the other can.

In addition to the above, intensity data showing the intensity of the energization actually applied to the drive means are detected and the energizing data compensated accordingly, so even if there is an anomaly in the compensation of one or both of the above, it is possible to set the correct energizing data, thereby providing a marked improvement in the reliability of the attitude control stability.

When, for example, an integral element is added to the energizing data compensation based on first and second disturbance data with the aim of preventing offset, and in addition to tis a limitation is imposed with respect to the energizing data with the aim of preventing over-energization caused by a compensation anomaly, because the system is also stabilized using compensation based on the intensity data, there is no risk of the phenomenon of windup occurring even if an anomaly in the compensation arising from the first and/or second disturbance data causes the limitation to exert a de-energizing effect. Thus, the result is attitude control with good stability, reliability and response.

BRIEF DESCRIPTION OF THE DRAWINGS

The objects and features of the present invention will become more apparent from a consideration of the following detailed description in conjunction with the accompanying drawings in which:

FIGS. 7*a* to 7*d* are flow charts of the operation of the system controller shown in FIG. 5*a.

DETAILED DESCRIPTION OF THE PREFERRED EMBODIMENTS

The invention will now be described with reference to the drawings.

Figure 1A:
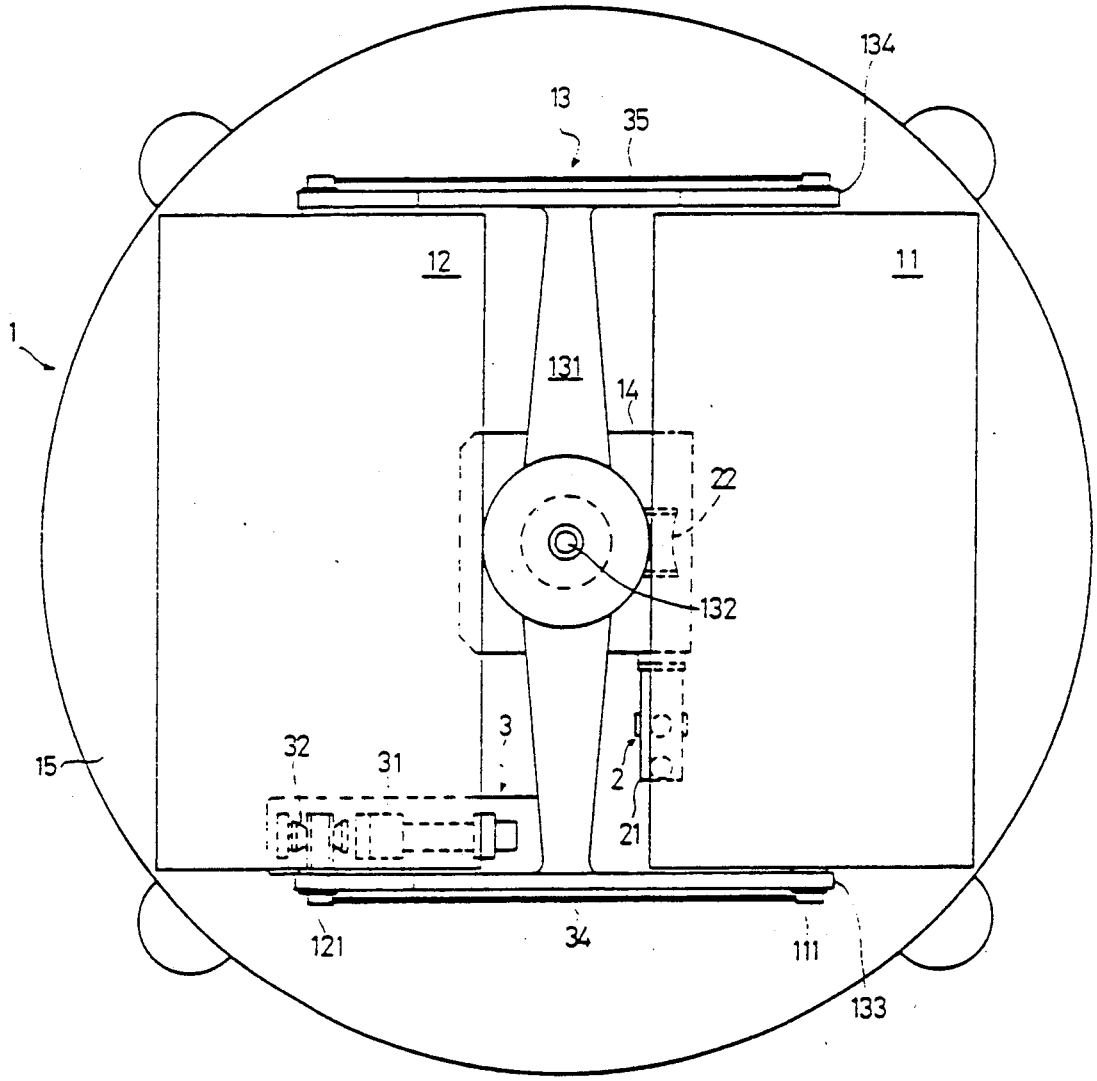
FIG. 1*a* is a plan view illustrating the mechanical configuration of a car-mounted satellite broadcast receiving system apparatus in accordance with an embodiment of the present invention.
Figure 1B:
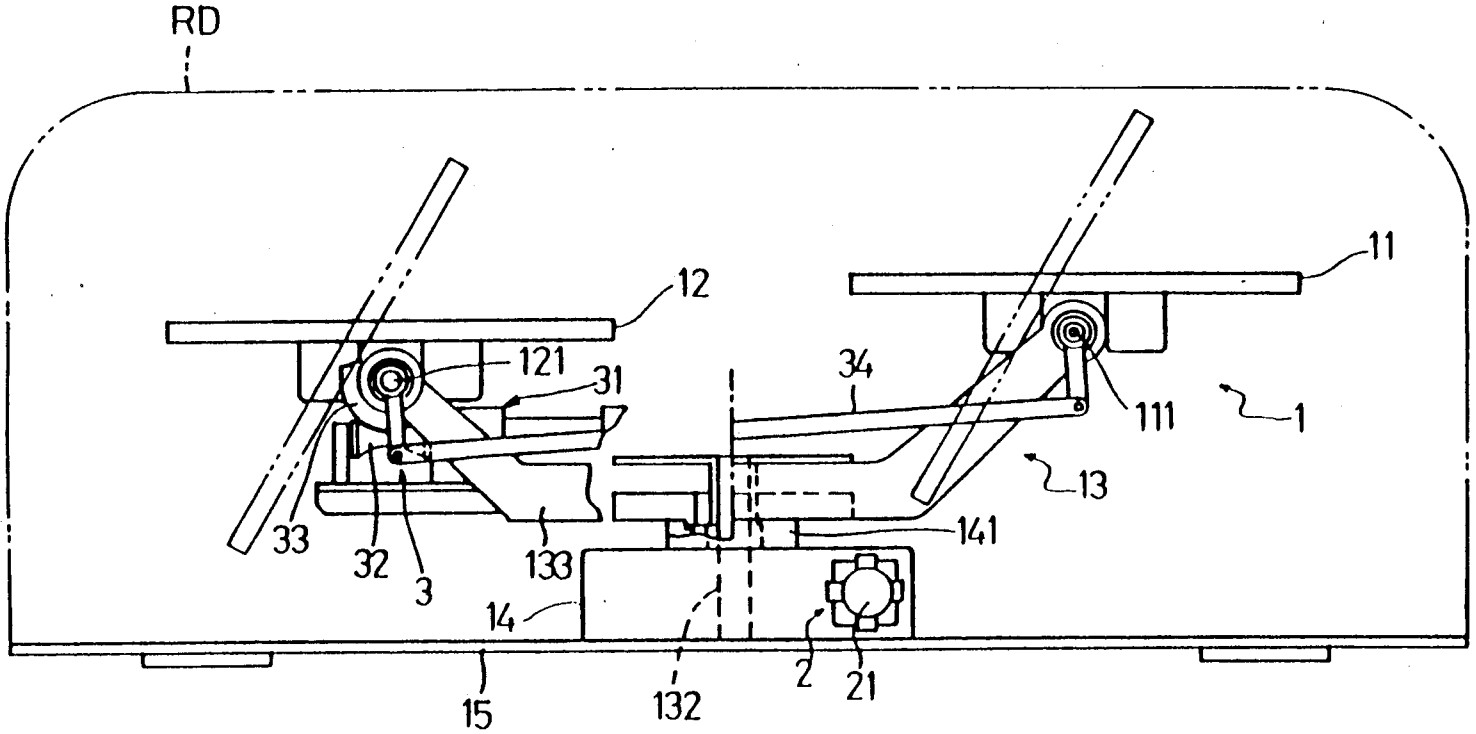
FIG. 1*b* is a front view of the apparatus shown in FIG. 1*a;*
Figure 2A:
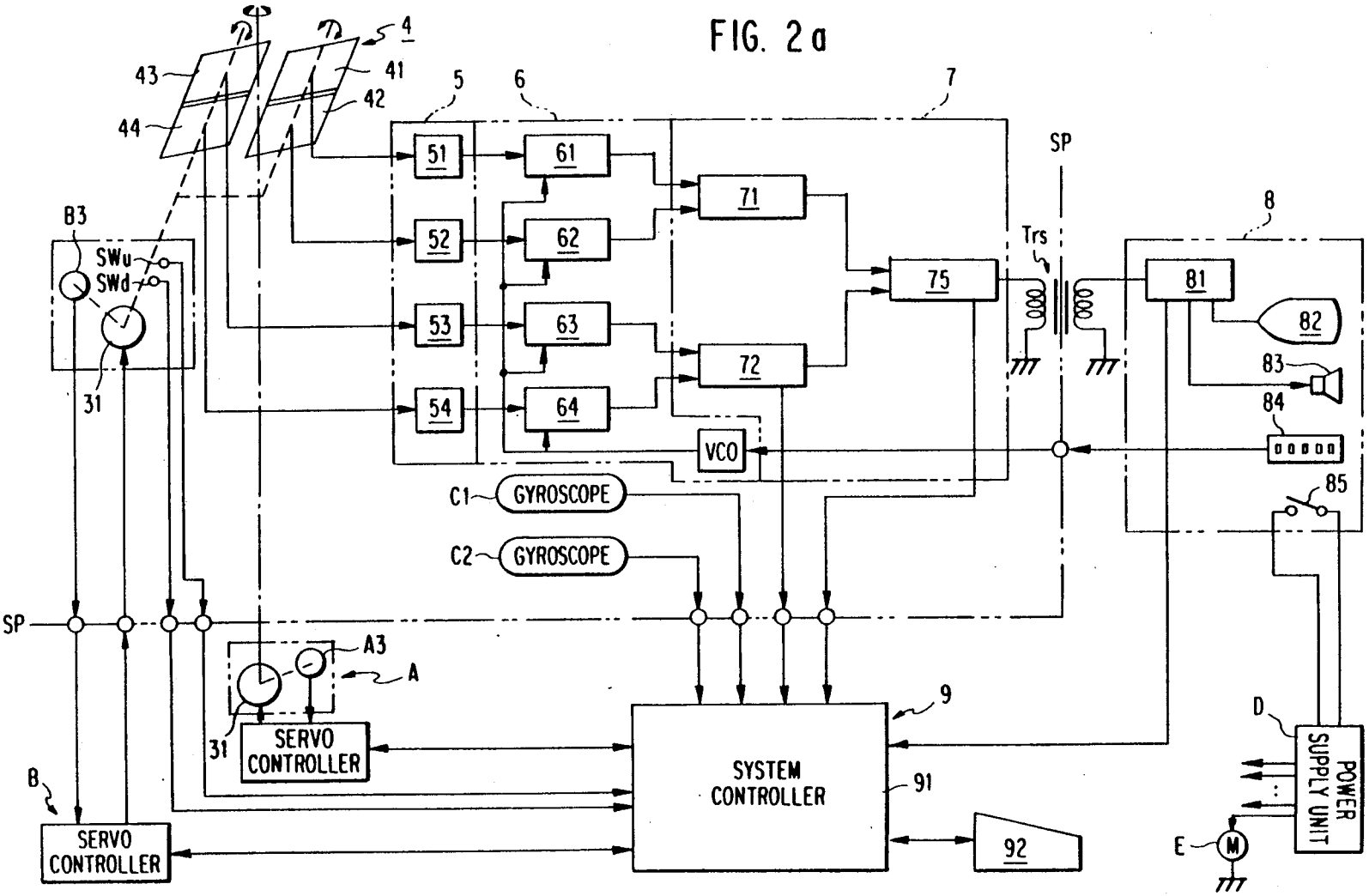
FIG. 2*a* is a block diagram showing the configuration of the control and signal processing systems of the first embodiment.

FIG. 1*a* and 1*b* show the mechanical configuration of a car-mounted satellite broadcast receiving system in accordance with an embodiment of the present invention, and FIG. 2*a* shows the configuration of the control and signal processing systems of the embodiment. This system employs a simultaneous correction and lobing arrangement that utilizes four plane antennas and gyroscopes to track a broadcast satellite, receive broadcasts from the satellite and output the picture and sound signals thus received to a television set installed in a car.

Details of each part of the system will now be described.

With reference to FIGS. 1*a* and 1*b*, the mechanical system can be divided into a support mechanism 1, an azimuth drive 2 and an elevation drive 3 for maintaining the beams of the plane antennas parallel and setting azimuth and elevation angles.

The main structural elements of the support mechanism 1 are antenna carriages 11 and 12, a swivel stand 13, a fixed stand 14 and a base 15. Antenna carriages 11 and 12 are identical flat, rectangular plates, and secured to the reverse side along the center line of the long dimension thereof are shafts 111 and 121 respectively. The plane antennas, signal processing circuitry, gyroscopes and so forth, described below, are mounted on these carriages.

The swivel stand 13 is equipped with a horizontal arm 131, a swivel shaft 132 and a pair of perpendicular arms 133 and 134. The swivel shaft 132 is affixed to the center of the lower face of the horizontal arm 131 so that it extends perpendicularly down from the arm. The perpendicular arms 133 and 134 are formed integrally with the horizontal arm 131 from which they extend perpendicularly upward, one at each end. The perpendicular arms 133 and 134 are the same shape; the ends of the shafts 111 and 121 secured to the antenna carriages 11 and 12 are pivotally attached to opposite ends of the arms, so that the shafts 111 and 121 are parallel. As shown in FIG. 1*b*, shaft 111 is disposed higher than shaft 121.

The fixed stand 14 is secured to the base 15 and the swivel stand 13 can turn. A thrust bearing 141 is provided between the swivel stand 13 and the fixed stand 14. The base 15 is attached to the roof of a car.

The azimuth drive 2 is constituted of an azimuth motor 21 and a worm gear 22, and a gearwheel that is not illustrated. The azimuth motor 21 is attached to the fixed stand 14 and the worm gear 22 is attached to the output shaft of the azimuth motor 21. The gearwheel that is not shown is attached to the swivel shaft 132 of the swivel stand 13 in engagement with the worm gear 22. Thus, the rotation of the azimuth motor 21 output shaft is transmitted to the swivel shaft 132 by the worm gear 22 and the gearwheel, thereby causing the swivel stand 13 to turn. In this embodiment, the above arrangement provides the swivel stand 13 with a maximum turning rate of about 180 degrees a second.

The elevation drive 3 consists of an elevation motor 31, a worm gear 32, a fan-shaped wheel 33 and linkages 34 and 35. The elevation motor 31 is attached to the perpendicular arm 133 of the swivel stand 13 and the worm gear 32 is attached to the elevation motor 31 output shaft. The fan-shaped wheel 33 is attached to the shaft 121 of the antenna carriage 12 in engagement with the worm gear 32. The linkages 34 and 35 link the ends of the antenna carriage 11 shaft 111 to the ends of the antenna carriage 12 shaft 121. Thus, the rotation of the elevation motor 31 output shaft is transmitted to the shaft 121 of the antenna carriage 12 by the worm gear 32 and the fan-shaped wheel 33 and, via the linkages 34 and 35, to the shaft 111 of the antenna carriage 11 so that the antenna carriages 11 and 12 are thereby pivoted simultaneously.

In this embodiment, the above arrangement provides the antenna carriages 11 and 12 with a maximum turning rate of about 120 degrees a second. However, this is limited to a range of $\pm 30°$ about the center of the beam of an antenna at an elevation angle of 35° relative to the base 15. The elements described above are covered by a radome RD equipped with a cooling fan.

With reference to FIG. 2*a*, the main components of the signal processing system are an antenna group 4, a BS converter group 5, a BS tuner group 6, an in-phase combining circuit group 7 and a television set 8. The signal processing system produces a combined signal from the radio waves received by the antenna group 4 which it outputs to the television set 8, and also detects error between the direction of the broadcast satellite and the direction in which the antenna beams are pointing.

The antenna group 4 includes four plane antennas 41, 42, 43 and 44. Plane antennas 41 and 42 are mounted on the antenna carriage 11 and plane antennas 43 and 44 on the antenna carriage 12. All of these antennas have the same specifications, and have a main beam with an offset angle (the angle of deflection from the normal) of about 35° and a half-value angle of about 7° at a service frequency of about 12 GHz. The main beams of the antennas are maintained parallel by the mechanical system described in the foregoing, and the azimuth angle is updated for all the antennas as a unit by means of the azimuth drive 2, and the elevation angle is updated for all the antennas as a unit by means of the elevation drive 3.

The BS converter group 5 includes two BS converters 51 and 52 mounted on the antenna carriage 11 and two BS converters 53 and 54 mounted on the antenna carriage 12. The input of each of the BS converters 51, 52, 53 and 54 is connected to the feedpoint of each of the corresponding plane antennas 41, 42, 43 and 44. Each of the BS converters converts the signal of about 12 GHz received by the corresponding plane antenna to a signal of about 1.3 GHz.

The BS tuner group 6 includes BS tuners 61 and 62 mounted on the antenna carriage 11 and BS tuners 63 and 64 mounted on the antenna carriage 12, and a voltage controlled oscillator (hereinafter abbreviated to VCO) 65. Each BS tuner uses a local oscillator signal provided by the VCO 65 is used to convert the 1.3 GHz signals converted by the corresponding BS converters 51, 52, 53 and 54 to an intermediate frequency signal of about 403 MHz. The signal that controls the oscillation frequency of the VCO 65 is provided by the channel selector 84 of the television set 8, via a slip ring (in the drawing the boundary is indicated by the line SP—SP).

The in-phase combining circuit group 7 includes an in-phase combining circuit 71 mounted on the antenna carriage and in-phase combining circuits 72 and 75 mounted on the antenna carriage 12.

The significance of the in-phase combining will now be described. With respect to azimuthal movements of the antenna apparatus, plane antennas 41 and 42 (or plane antennas 43 and 44) can be represented by the model shown in FIG. 3*a*, i.e., as a rotation of two linear antennas about an axis of rotation 13' (representing the swivel stand 13).

In this case, the angle $\theta$ formed between the antenna beam, indicated by the dashed line, and the radio wave, indicated by the single-dot broken line (and hereinafter referred to as the azimuth deflection angle) coincides with the angle $\theta'$ formed between a line connecting the centers of the antennas and the plane of the radio waves, indicated by the double-dot broken line (and hereinafter referred to as the azimuth phase angle) and are changed by azimuthal rotation. That is, if the broadcast satellite (which should be thought of as a projected plan image) is in the direction in which the beams of the plane antennas 41 and 42 are oriented, the azimuth deflection angle $\theta$ and the azimuth phase angle $\theta'$ will become zero and the distance between each antenna and the satellite will therefore be the same, while in other cases a distance differential $L_\theta$ given by $l_{74} \cdot \sin\theta$ will be produced (here, $l_\theta$ is the distance between the plane antennas 41 and 42).

Compared to the distance between the antennas and the satellite, this distance $L_{74}$ is extremely small and does not have any affect on the strength of the radio waves coming from the satellite. However, as the radio waves have periodicity, the effect on the phase differential is considerable. If the radio waves arriving at the plane antenna 41 are shown by cos $\omega t$, then the radio waves arriving at the plane antenna 42 will be delayed by a time $L_\theta/c$, which can therefore be expressed as $$\cos\omega(t-L_\theta/c)=\cos(\omega t-2\pi\cdot l_\theta\cdot\sin\theta/\lambda) \quad (1)$$

where $\omega$ is the angular velocity of the radio wave, c is the velocity of propagation and $\lambda$ is the wavelength.

If the signals received by the antennas are combined without removing this phase difference $2\pi\cdot l_\theta\cdot\sin\theta/\lambda$, the signals will interfere with each other. This being the case, in the in-phase combining circuit 71, the phase difference between the signals of the plane antennas 41 and 42 is removed and the signals are combined, and in the in-phase combining circuit 72 the phase difference between the signals received by the plane antennas 43 and 44 is removed and the signals combined. Also, as here $l_\theta$ and $\lambda$ are known, the azimuth deflection angle $\theta$ can be found by detecting the phase difference $2\pi\cdot l_\theta\cdot\sin\theta/\lambda$.

Figure 3A:
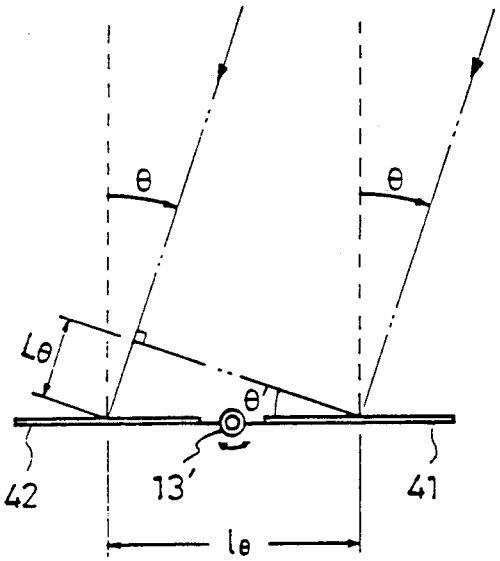
FIGS. 3*a* to 3*c* are explanatory diagrams to illustrate the principle on which the detection of phase differences in received signals and the direction of the broadcast satellite is based.
Figure 3B:
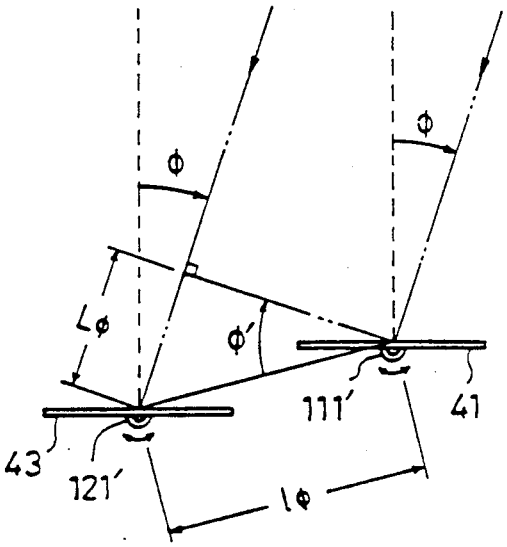

With respect to elevational movement of the antenna apparatus, the plane antennas 41 and 43 (or plane antennas 43 and 44) can be represented, as shown by the model in FIG. 3*b*, as a rotation of two linear antennas about different axes 111' and 121' (representing shafts 111 and 121) while maintaining them parallel.

In this case, the angle $\phi$ formed between the antenna beam indicated by the dashed line and the radio wave indicated by the single-dot broken line (hereinafter referred to as the elevation deflection angle) does not coincide with the angle $\phi'$ formed between a line connecting the centers of the antennas and the plane of the radio waves, indicated by the double-dot broken line, (hereinafter referred to as the elevation phase angle). However, if El is the angle formed between the line connecting the centers of the antenna (hereinafter referred to as the elevation reference line) and the angle of the antennas (hereinafter referred to as the elevation angle), then $$\phi'=\phi+El \quad (2)$$

Therefore, in this embodiment, also, the same thinking described above can be applied with respect to the elevation direction.

Figure 2B:
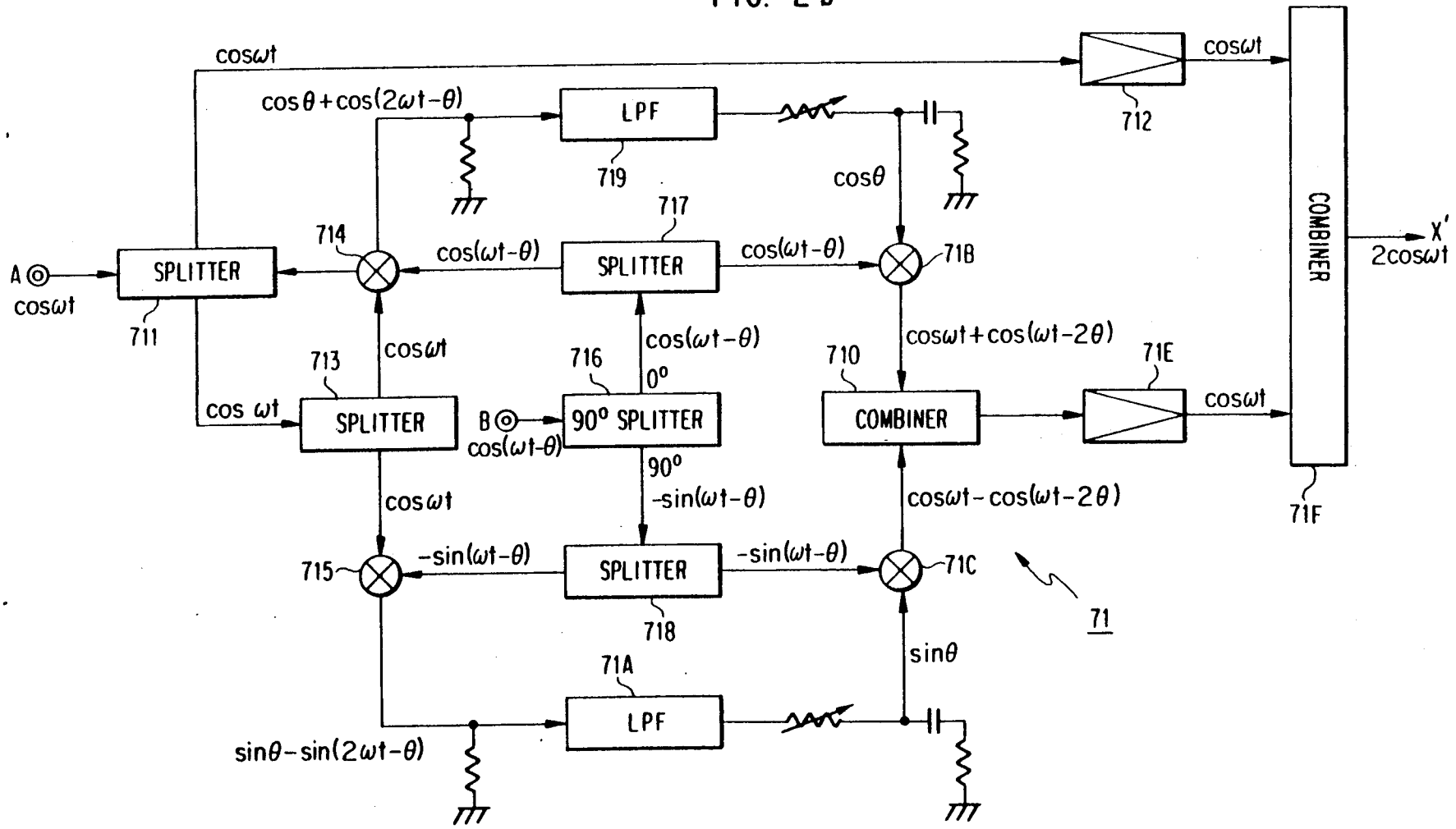
FIGS. 2*b* to 2*d* are block diagrams showing details of the configuration of FIG. 2*a;*

Details of each of the circuits will now be described. The in-phase combining circuit 71 is formed mainly of a multiplicity of splitters, mixers, low-pass filters and combiners, as shown in FIG. 2*b*. An intermediate frequency signal based on the signal received by the plane antenna 41 is applied to terminal A from the BS tuner 61 and an intermediate frequency signal based on the signal received by the plane antenna 42 is applied to terminal B from the BS tuner 62. The signal input via terminal A is distributed to an amplifier 712 and a splitter 713 by a splitter 711, and to mixers 714 and 715 by the splitter 7!3, while the signal input via terminal B is distributed to splitters 717 and 718 by a 90° phase splitter 716, and from the splitters 717 and 718 it is further distributed to mixers 714, 715, 71B and 71C. In this case, the splitter 716 distributes the input signal phase-shifted 90° with respect to the splitter 718, so that the signal distributed to the mixers 715 and 71C via the splitter 718 imparts a 90° phase-shift to the intermediate frequency signal that is based on the signal received by the plane antenna 42.

Accordingly, therefore, between the intermediate frequency signal applied to terminal A from the BS tuner 61 and the intermediate frequency signal applied to terminal B from the BS tuner 62, a phase shift arises that is based on the positions of the plane antennas 41 and 42. If the intermediate frequency signal output by the BS tuner 61 is cos $\omega t$ and the phase difference is $\Theta$, then the intermediate frequency signal output by the BS tuner 62 can be expressed as cos $(\omega t-\Theta)$ and the signal distributed to the mixers 715 and 71C via the splitter 718 can be expressed as $-\sin(\omega t-\Theta)$.

The mixer 714 calculates cos $\omega t\cdot\cos(\omega t-\Theta)$ with respect to the signals input via the splitters 713 and 717. This calculation can be written cos $\Theta+\cos(2\omega t-\Theta)$ (arithmetical coefficients are omitted, here and throughout, as having no significance), so the DC component cos $\Theta$ can be extracted by removing the AC component by means of a low-pass filter 719. This signal is input to the mixer 71B, which performs the calculation cos $\Theta\cdot\cos(\omega t-\Theta)$.

The mixer 715 calculates $-\cos\omega t\cdot\sin(\omega t-\Theta)$ with respect to the signals input via the splitters 713 and 718 This calculation can be expressed as sin $\Theta+\sin(2\omega t-\Theta)$, so the DC component sin $\Theta$ can be extracted by removing the AC component by means of a low-pass filter 71A. This signal is input to the mixer 71C, which performs the calculation $-\sin\Theta\cdot\sin(\omega t-\Theta)$.

The combiner 71D adds the output of the mixer 71B to the output of the mixer 71C and performs the calculation $$\cos\Theta+\cos(\omega t-\Theta)-\sin\Theta\cdot\sin(\omega t-\Theta).$$

The result of this enables the signal with the in-phased component cos $\omega t$ to be extracted, and after the level of the signal has been adjusted by an amplifier 71E it is combined with the output of the amplifier 712 in a combiner 71F.

In FIG. 2*b*, the output of the in-phase combining circuit 71 is shown as 2 cos $\omega t$, but the coefficient has no arithmetical significance (i.e., amplitude component) and should be understood (here and throughout) as signifying the in-phase combining of intermediate frequency signals from the BS tuners 61 and 62.

Figure 2C:
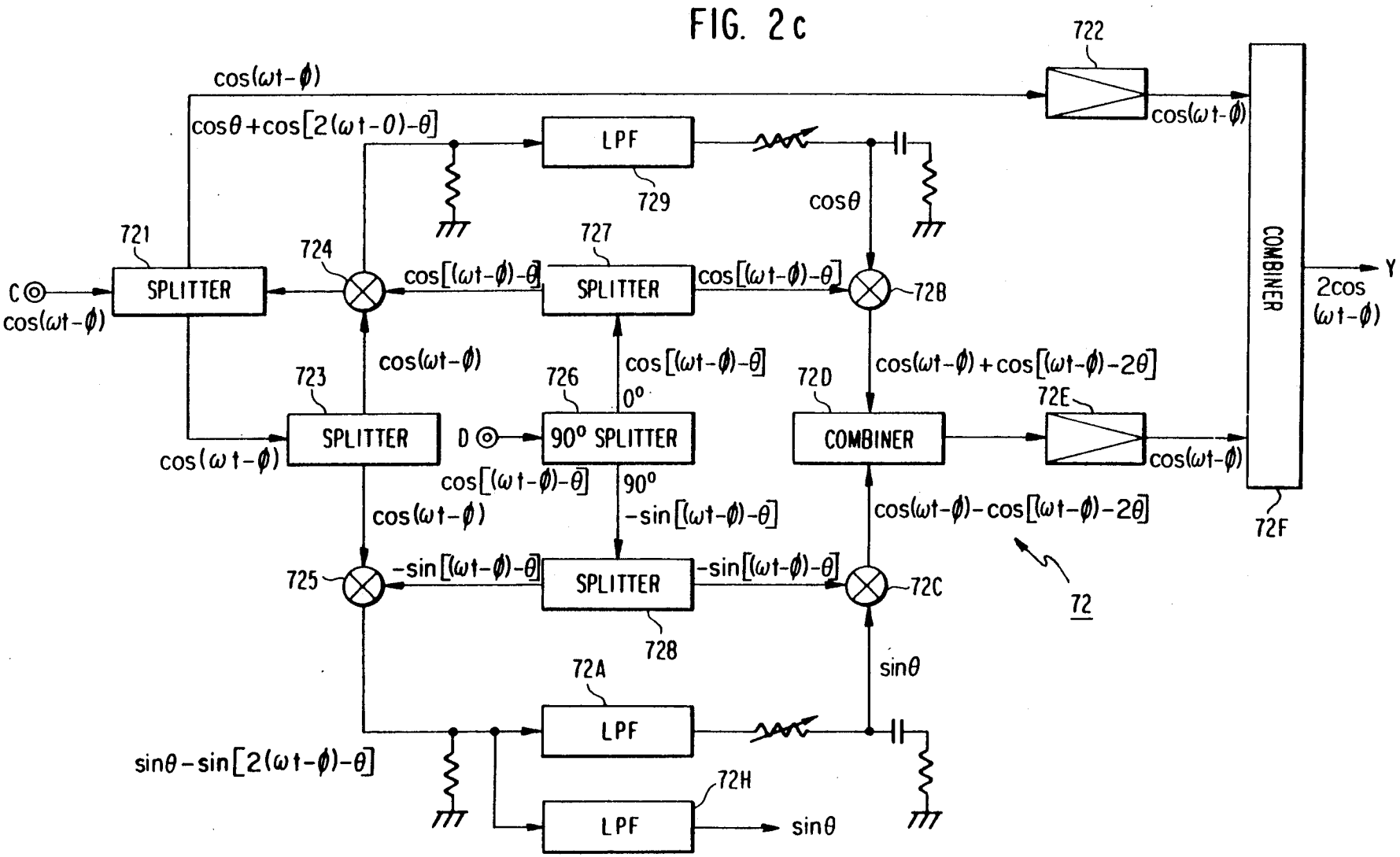

The in-phase combining circuit 72 performs the in-phased combining of the intermediate frequency signals from the BS tuners 63 and 64 in exactly the same way as the in-phase combining circuit 71. As shown in FIG. 2*c*, the only difference between the in-phase combining circuits 71 and 72 is that the 72 is provided with an additional low-pass filter 72H.

Accordingly, therefore, between the intermediate frequency signal applied to terminal A from the BS tuner 61 and the intermediate frequency signal applied to terminal B from the BS tuner 63, a phase shift arises that is based on the positions of the plane antennas 41 and 43. If the intermediate frequency signal output by the BS tuner 61 is cos $\omega t$ and the phase difference is $\Phi$, then the intermediate frequency signal output by the BS tuner 63 can be expressed by $\cos(\omega t-\Phi)$. Also, if $\Phi$ is the phase shift arising from the difference in the positions of the plane antennas 43 and 44, then the intermediate frequency signal output by the BS tuner 64 is $\cos(\omega t-\Phi-\Theta)$. Therefore, as can be seen by referring to the equations in FIG. 2*c*, if the $\omega t$ in the description of the in-phase combining circuit 71 is replaced by ($\omega t-\Phi$), the signal processing procedures of the two in-phase combining circuits are the same, and by means of the combiner 72F a signal 2 $\cos(\omega t-\Phi)$ can be obtained that is produced by the in-phase combining of the intermediate frequency signals output from the BS tuners 63 and 64 (for details, please refer to the aforementioned explanation).

<<<MARK>>>

The low-pass filter 72H removes the AC component from the mixer 725 output signal $-\cos(\omega t-\Phi)\cdot\sin(\omega t-\Phi-\Theta)$ to extract the DC component $\sin\Theta$ (hereinafter referred to as the azimuth error signal) and outputs it to the system controller 91.

Figure 2D:
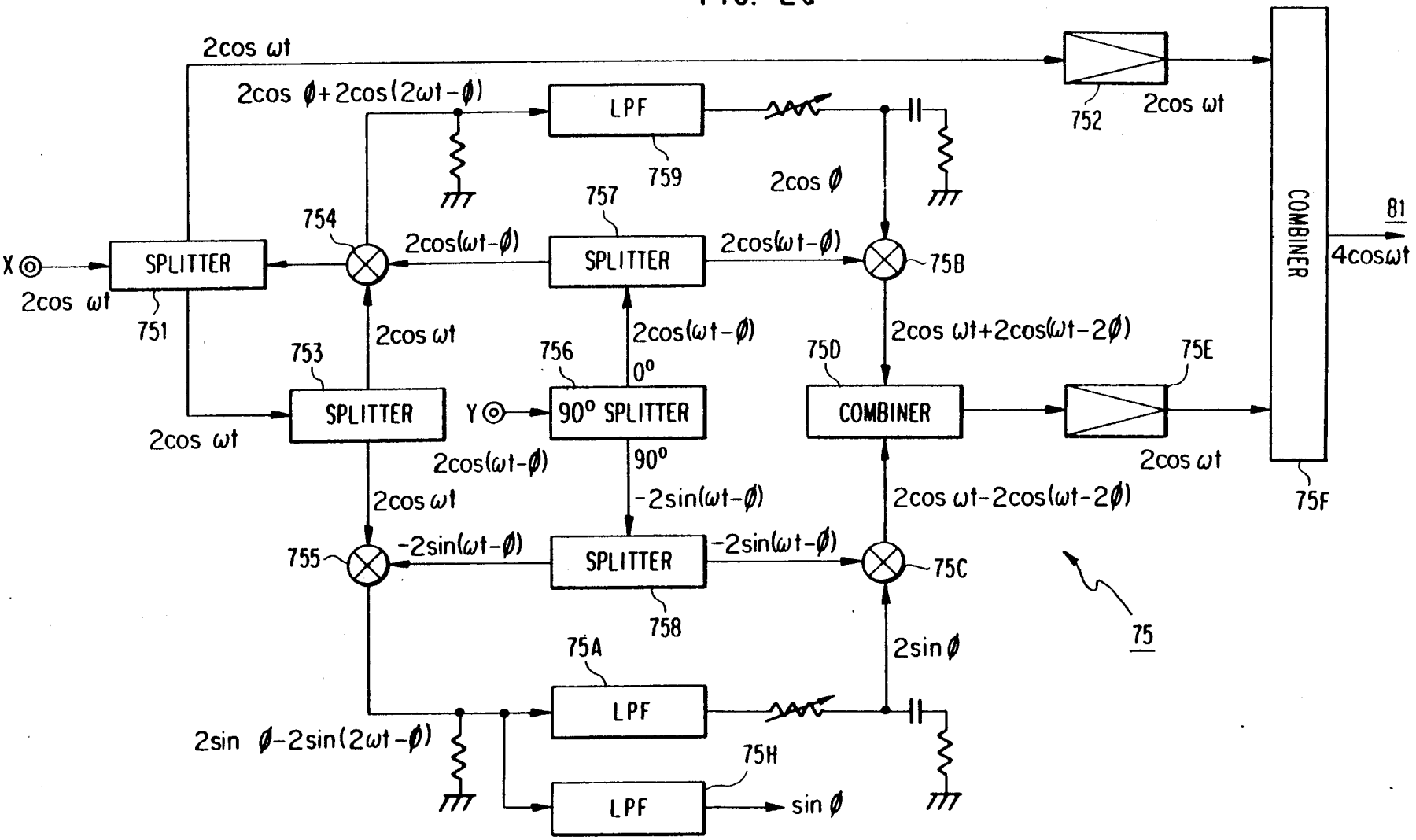

The output signals of the in-phase combining circuits 71 and 72 are also subjected to in-phase combining by the in-phase combining circuit 75. As shown in FIG. 2*d*, the in-phase combining circuit 75 has the same configuration as the in-phase combining circuit 72 and performs the signal processing in accordance with the equations shown in the drawing. If the $\Theta$ in the description of the in-phase combining circuit 71 is replaced by $\Phi$, the signal processing procedures of the two in-phase combining circuits become the same, so for details please refer to the aforementioned description. Thus, the output signal of the BS tuners 51, 52, 53 and 54 are subjected to in-phase combining by the in-phase combining circuits 71, 72 and 75 to thereby provide signal 4 $\cos\omega t$.

The low-pass filter 72H removes the AC component from the mixer 755 output signal $-\cos\omega t\cdot\sin(\omega t-\Phi)$ to extract the DC component $\sin\Phi$ (hereinafter referred to as the elevation error signal) and outputs it to the system controller 91.

Again with reference to FIG. 2*a*, the output of the in-phase combining circuit 75 is input to the television set 8 via an isolation type coupling transformer Trs.

The television set 8 has a demodulator circuit 81, a CRT 82, a speaker 83, the channel selector 84 and a main switch 83, and is installed in the car. The demodulator circuit 81 demodulates signals from the in-phase combining circuit 75, the CRT 82 outputs pictures and the speaker 83 outputs sound. An AGC signal used for automatic gain control is branched off for input to the system controller 91.

As has been described, the channel selector 84 is manually operated to set the oscillation frequency of the VCO 65; the manually operated main switch 85 is for feeding electrical power to a power supply unit D, from which power at the prescribed voltage is supplied to each component of the configuration, and to a cooling fan E provided in the radome RD.

The control system consists of a system control unit 9, an azimuth drive control unit A, an elevation drive control unit B, and various sensors, etc. The azimuth drive control unit A is constituted of a rotary encoder A3 connected to the azimuth motor 21 and an azimuth servo controller A1 that controls the energizing of the azimuth motor 21. The elevation drive control unit B is constituted of a rotary encoder B3 which is connected to the elevation motor 31 and the elevation servo controller B1 for controlling the energization of the elevation motor 31.

The rotary encoder A3 detects the azimuth angle, using as a reference an attitude whereby the antenna beam is directed toward the vehicle's direction of travel It detects the angle of rotation of the swivel stand 13, taking clockwise rotation as positive. The rotary encoder B3 is connected to the elevation motor 31 and detects the angle of rotation of the antenna carriages 11 and 12, meaning the angle of elevation, regarding up relative to the elevation reference line as positive.

The main sensors are gyroscopes C1 and C2, and limit switches SWu and SWd. The gyroscopes C1 and C2 are mounted on the antenna carriage 12 and are provided with degrees of freedom in the azimuth and elevation directions, and via slip rings output signals to the system controller 91 indicating relative deviation in each direction.

The limit switches SWu and SWd are both provided on the elevation drive 3, SWu for detecting the upper limit of the antenna carriage rotation, which is when the antenna beam is pointing up at an angle of 65° with respect to the base 15, and SWd for detecting the lower limit, which is when the beam angle is 5°.

The system control unit 9 is provided with the system controller 91 and a control panel 92, and is installed in the vehicle. The system controller 91 provides the azimuth servo controller Al and the elevation servo controller B1 with the necessary instructions for controlling the antenna, in accordance with azimuth error signals and elevation error signals from the in-phase combining circuit 75, AGC signals from the demodulator 81, or gyro data from the gyroscopes C1 and C2 showing relative deviation in the azimuth and elevation directions, or on the basis of instructions input manually via the control panel 92.

Figure 4A:
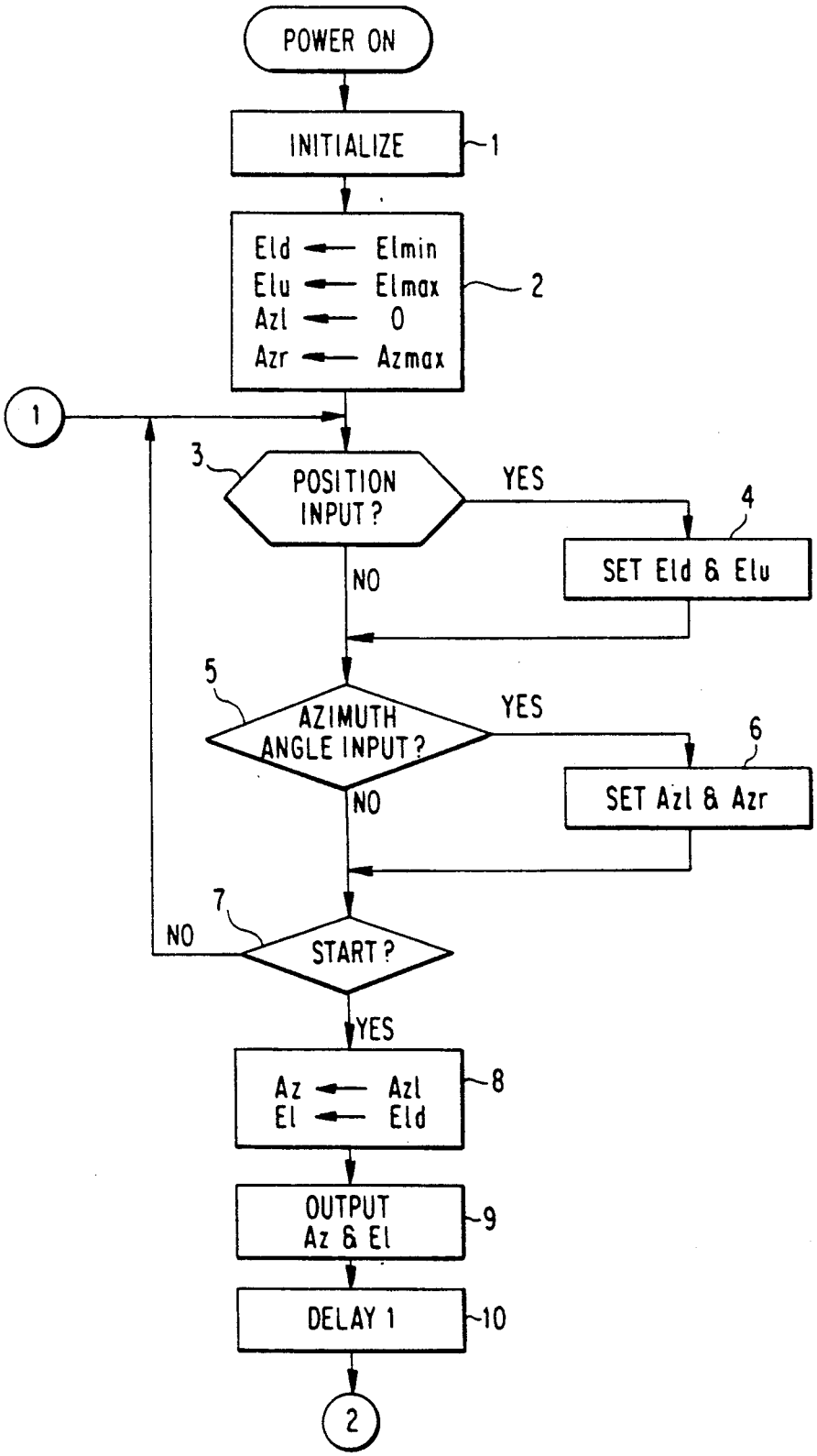
FIGS. 4*a* to 4*c* are flow charts of the operation of the system controller shown in FIG. 2*a;*
Figure 4B:
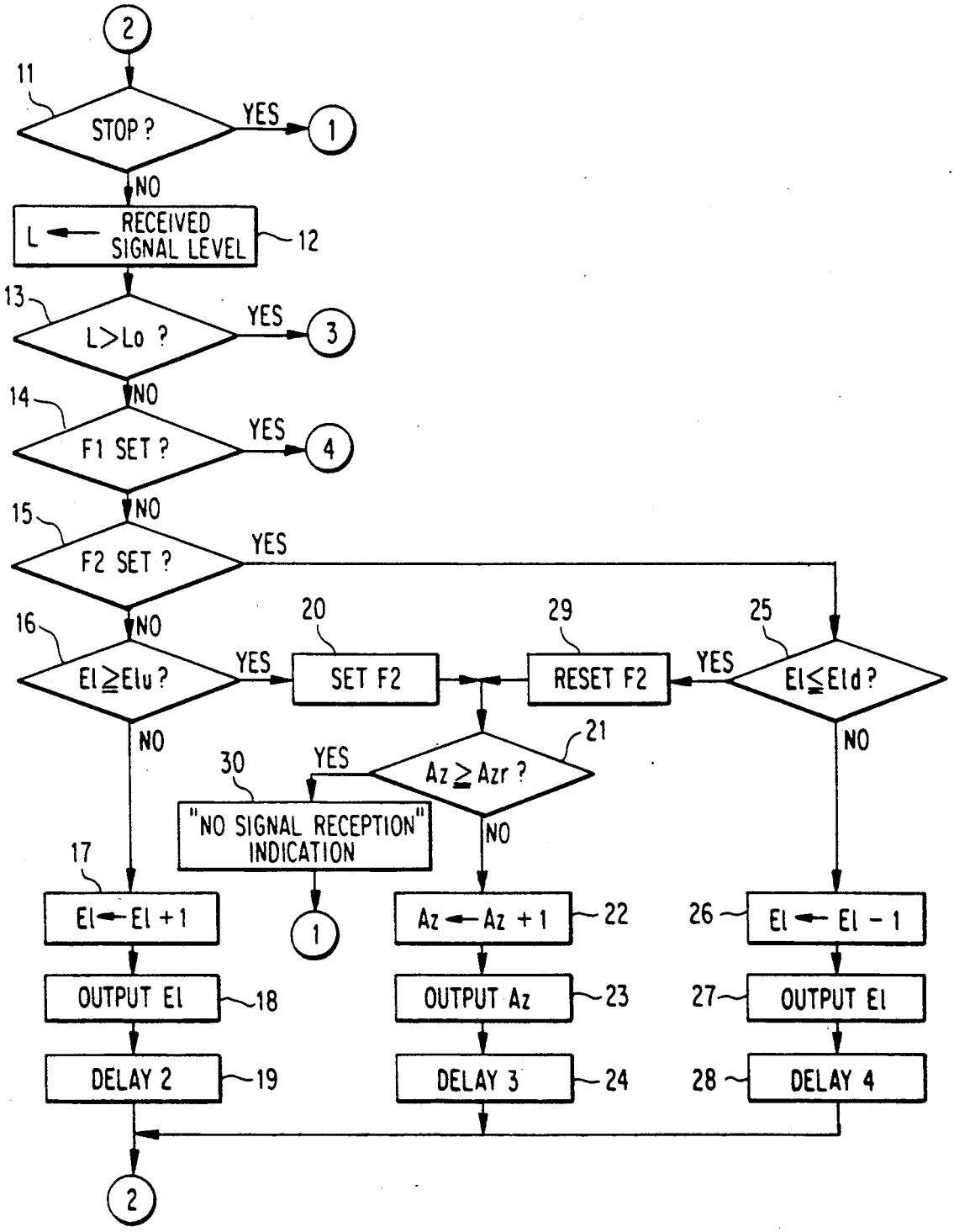
Figure 4C:
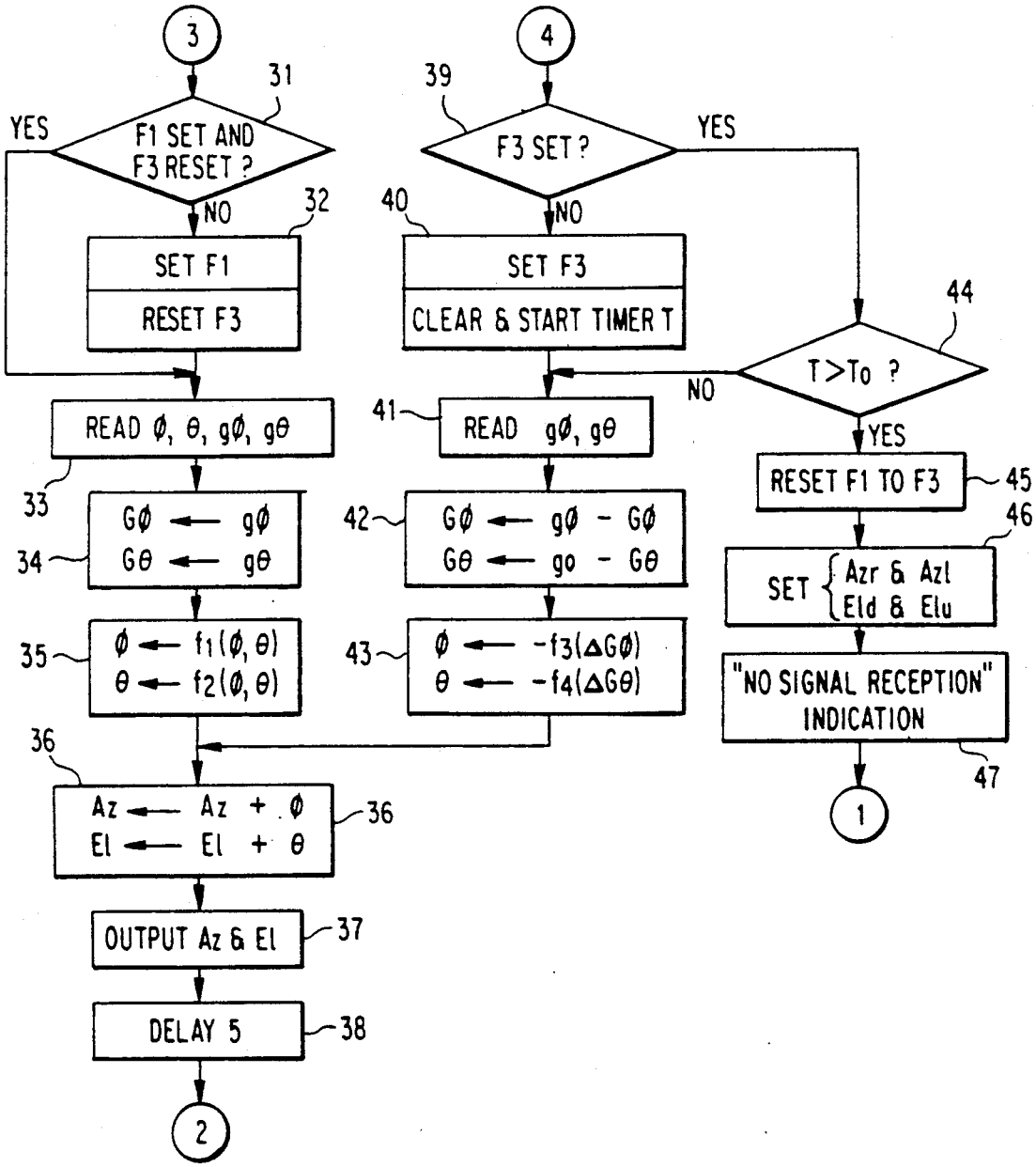

The attitude control functions performed by the system controller 91 will now be described with reference to the flow charts of FIGS. 4*a* to 4*c*.

When the main switch 85 is closed to supply the required voltage to each part of the system, in step 1 the system controller 91 initializes system memory, registers and flags. In step 2 initial data are input into registers employed in the satellite search process. To provide settings that cover the whole of the search range in the initialized state, the registers E1d and E1u which limit the search range in the elevation direction are set for a lower limit value E1 min and an upper limit E1 max, and the registers Azl and Azr which limit the search in the azimuth are set to a reference value of zero and a maximum value of Az max.

Steps 3 to 7 form an input loop that waits for input from the control panel 92. When data indicating the current position of the vehicle are input while in this loop, the elevation of the satellite can be designated to a certain extent, so in step 4 data limiting the search range in the corresponding elevation direction are input to registers E1d and E1u. When data showing the azimuth angle are input, the azimuth of the satellite can be designated to a certain extent, so in step 6 data limiting the search range in the corresponding azimuth direction are input to registers Azl and Azr.

When a start instruction is input via the control panel 92, the loop is interrupted and in step 8 the value in register Azl showing the left-most limit of the azimuth search range is input into the register Az and the value in register E1d showing the lower limit of the search range in the elevation direction is input into the register E1. In step 9 the values in registers Az and E1 are input to the servo controllers Al and B1, and in accordance with these values the servo controllers energize the motors to orient the antenna beams in a direction that is defined by the azimuth angle indicated by the register Az value and the elevation angle indicated by the register E1 value step 10 provides a prescribed delay time to allow this to be completed.

The search process consists of monitoring the received signals and updating the orientation of the antenna beam in the search for the satellite. The updating process will now be described.

In step 16 the value in register E1 is compared with the value in register E1u, which is the upper limit value in the elevation direction. If the register E1 value has not reached the upper limit value, in step 17 the register E1 value is incremented by one, and in step 18 that value is transferred to the elevation servo controller B1. The elevation servo controller B1 then energizes the elevation motor 31, which increases the angle of beam elevation by one step. In step 19 there is a prescribed delay time. The above sequence is repeated until the register E1 value reaches the value in register E1n, at which point flag F2 is set, in step 20.

In step 21, the value in register Az is compared with the value in register Azr, which is the azimuthal limit value in the clockwise direction. If the register Az value has not reached the limit value, in step 22 the register Az is incremented by one, and in step 23 that value is transferred to the azimuth servo controller A1. The azimuth servo controller Al then energizes the azimuth motor 21 and the azimuth angle of the antenna beam is updated by one clockwise step. In step 24 there is a prescribed delay time.

After flag F2 is set, the process moves to the sequence starting with step 25, and the value in register E1 is decremented until it reaches the elevation lower limit value in register E1d, with each decrement being matched by a corresponding decrease in the elevation angle of the antenna beam.

When the register E1 value reaches the lower limit value E1d, flag F2 is reset, in step 29, and in the sequence starting with step 21 the azimuth angle of the antenna beam is updated by one clockwise step.

Thus, in the process of searching for the satellite the ranges defined by the values held in registers Azl, Azr, E1d and E1u are raster-scanned. If the satellite is not located, the process moves from step 21 to step 30 and an indicator on the control panel 92 indicates that reception is inoperative, and the process returns to step 3. Also, inputting a stop instruction via the control panel 92 causes the search to terminate immediately and the process to return to step 3.

If a satellite is found and the received signal level in register L exceeds a prescribed level $L_o$, the process moves from step 13 to step 31, and tracking commences.

In step 31 the state of flags F1 and F3 is checked. As flag F1 was reset at the outset, in step 32 flag F1 is set and flag F3 is reset.

In step 33, the azimuth phase difference data $\Phi$ based on azimuth error signals, the elevation phase difference data $\theta$ based on elevation error signals, azimuth gyro data $g_\theta$ and elevation gyro data $g_\theta$ are read. Then, in step 34, gyro data $g_\theta$ and $g_\phi$ are input into registers $G_\theta$ and $G_\phi$, respectively; and in step 35, data on the deflection angle of the satellite in the azimuth and elevation directions relative to the current attitude of the antenna as shown by phase difference data $\phi$ and $\theta$ are input to the respective registers $\phi$ and $\theta$.

In step 36, the value in register $\phi$ is added to register Az and the value in register $\Theta$ is added to register E1. However, with Az max as the modulus of register Az, if the addition would cause the value in register Az to exceed Az max, it is subtracted.

In step 37 the values in registers Az and E1 are output to the servo controllers, and after the prescribed delay in step 38 the process reverts to step 11.

The satellite is tracked by repetitions of the above process. During the course of this procedure, however, if the vehicle should enter a tunnel or the shadow of a building or suchlike, the signal level will drop. If in such a case the received signal drops below the prescribed level $L_o$, in step 13 tracking is suspended temporarily and the process moves to the sequence starting with step 14 to perform gyro control.

In step 14 the state of flag F1 is checked. As flag F1 was set in step 32, the process moves to step 39 where the state of flag F3 is checked. As flag F3 was reset directly following the suspension of the tracking process, the process moves to step 40 in which flag F3 is set and timer T is started to measure the length of time the received signal level continues to be low.

In step 41, azimuth gyro data $g_\theta$ and elevation gyro data $g_\phi$ are read. Registers $G_\theta$ and $G_{100}$ contain gyro data from immediately prior to the drop in the received signal level, so the differences between gyro data $g_\theta$ and the value in register $G_\phi$, and between gyro data $g_\phi$ and the value in register $G_\phi$ correspond to azimuthal and elevational deviation in the current antenna attitude, relative to the antenna attitude immediately prior to the drop in the level of the received signal. Accordingly, in step 42 these differences are obtained, and in step 49 data showing the azimuthal and elevational deflection angles of the current antenna attitude relative to the antenna attitude immediately prior to the drop in the level of the received signals are input into the respective registers $\Phi$ and $\Theta$. The sign (−) in the equation shown in step 43 signifies the input of data against the relative deviation in antenna attitude.

The process then moves to step 36. The subsequent steps have already been explained, so further explanation here is omitted.

Thus, when the received signal level drops below the prescribed level $L_o$ during satellite tracking, the antenna attitude immediately prior to the drop is maintained, using the gyro data.

If the received signal level exceeds the prescribed level $L_o$ by the time a prescribed time $T_o$ has elapsed, the process moves from step 13 to steps 31 and 32 and tracking is restarted. If the received signal level does not recover during that time, the process moves from step 44 to step 45, and to the succeeding steps.

In step 45, flags F1 to F3 are reset, and in step 46 data limiting the range of the search are input into registers Azr, Azl, E1d and E1u for when searching is to continue. In the azimuth the values depend on the bearing angle of the vehicle, so a full-circle search range is set (maximum value Az max is input into register Az and a reference value 0 is input into register Azl). In the elevation direction, however, it depends on the position of the vehicle, so the search range is set on the basis of the value in the E1 register that indicates the angle of elevation of the antenna unit at that time.

Following this, in step 47 the indicator on the control panel 92 indicates that reception is inoperative, and the process returns to step 3. Also, if a stop instruction is input via the control panel 92 during the tracking and gyroscope control operations, these processes are terminated immediately in step 11 and the process returns to step 3.

To summarize, movement of the radio wave source relative to the antenna is detected and the antenna attitude controlled accordingly, which eliminates the need for the type of large, heavy flywheels or rate gyroscopes that have been applied conventionally.

Also, dividing the antennas into two groups decreases the inertia in the elevational direction and enables the size and weight of the mechanisms that provide the driving force in that direction to be reduced, resulting in a lower inertia even when the antennas are driven as a single unit, which provides improved response to the type of intensive attitude changes that a small vehicle undergoes, thereby ensuring reliable communication.

Combining the outputs of the plane antennas in phase enables the gain of the antennas to be increased without changing the pointing characteristics of the antennas.

A second embodiment will now be described, with reference to FIG. 3*b*. In FIG. 3*b*, the focus is on elevational movements of the antenna apparatus shown in FIGS. 1*a* and 1*b*. Plane antennas 41 and 43 (or 42 and 44) are represented as linear antennas rotatable about axes of rotation 111' and 121'. Elevational rotation will change the elevation deflection angle $\phi$, but elevation phase angle $\phi'$ will be constant. It was found that it was difficult to directly detect the elevation deflection angle $\phi$ from the phase difference in signals received by antennas separated in the plane of elevational rotation, i.e., plane antenna 41 and 43 or 42 and 44.

Figure 8A:
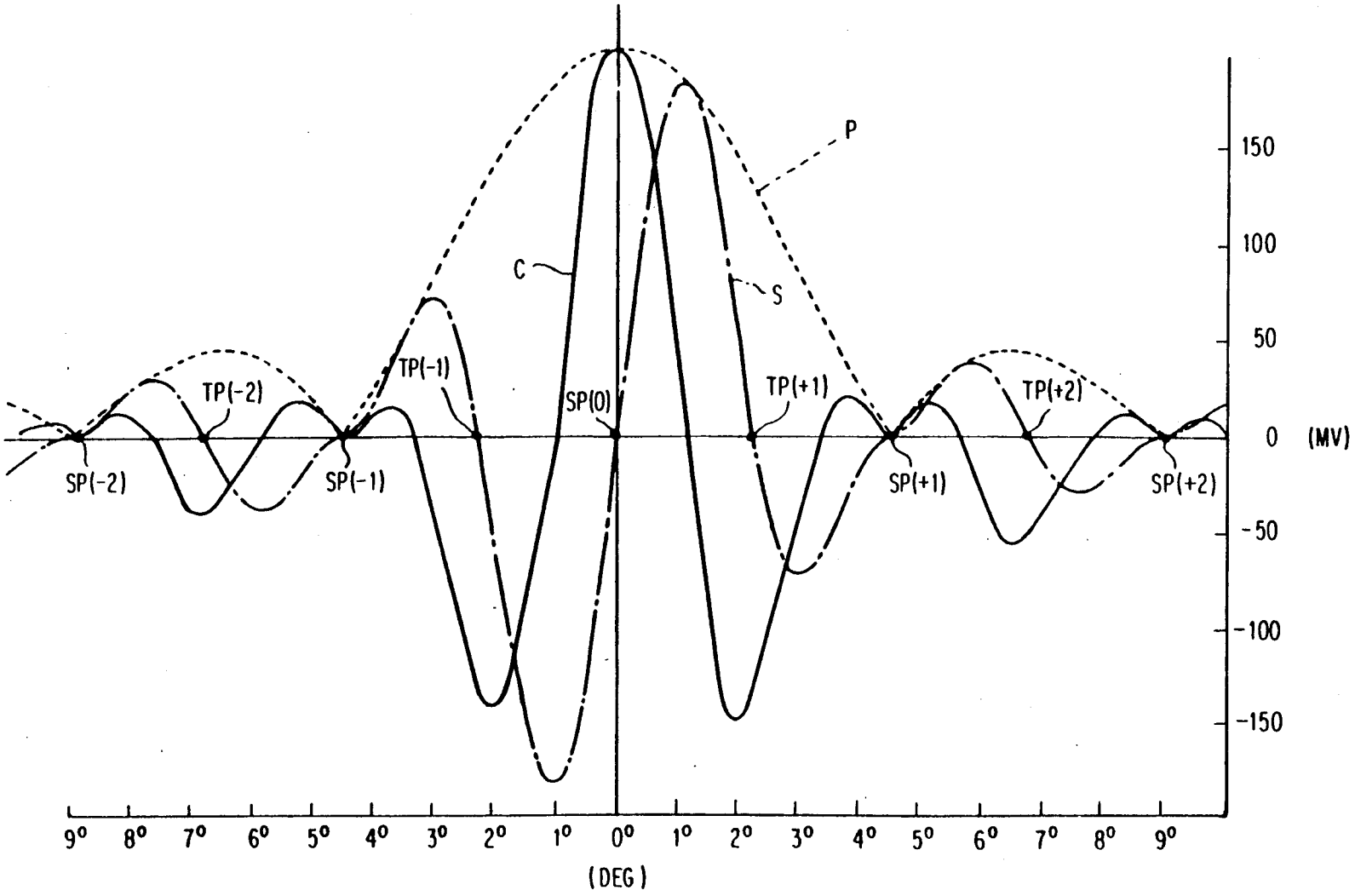
* and FIG. 8*a* is a graph showing the azimuth error voltage cosine and sine components and the main beam as functions of the azimuth deflection angle.

The various error signals become Bessel functions, so large numbers of pseudo stable points are produced and there is a possibility of control error. Take, for example, the curve s of FIG. 8*a* showing the relationship between the azimuth error signal sin $\Theta$ and the azimuth deflection angle $\theta$. From this it can be seen that the alternation period of the azimuth error signal sin $\Theta$ is far shorter than the azimuth deflection angle $\theta$ period (360°), and in addition to the normal stable point SP(0), large numbers of pseudo stable points . . . . , SP(−1), SP(−2), SP(+1), SP(+2), . . . . , appear in the azimuth of the antenna. Because of this, when the extracted error signals are used without modification (meaning to the extent that on special conditions are attached) for attitude control, when the deflection angle is large the antennas may become oriented toward the pseudo stable points. More specifically, if the azimuth deflection angle is between alternation points TP(−1) and TP(+1) the antenna will orient toward the normal stable point SP(0), but if it is between TP(−2) and TP(−1) it will orient toward pseudo stable point SP(−1), and if it is between TP(+1) and TP(+2) it will orient toward pseudo stable point SP(+1).

In order to solve this problem, the second embodiment incorporates improvements to the first embodiment. The following description relates mainly to these improvements.

As the mechanical configuration is the same as that of the first embodiment, further description thereof is omitted here.

Figure 5A:
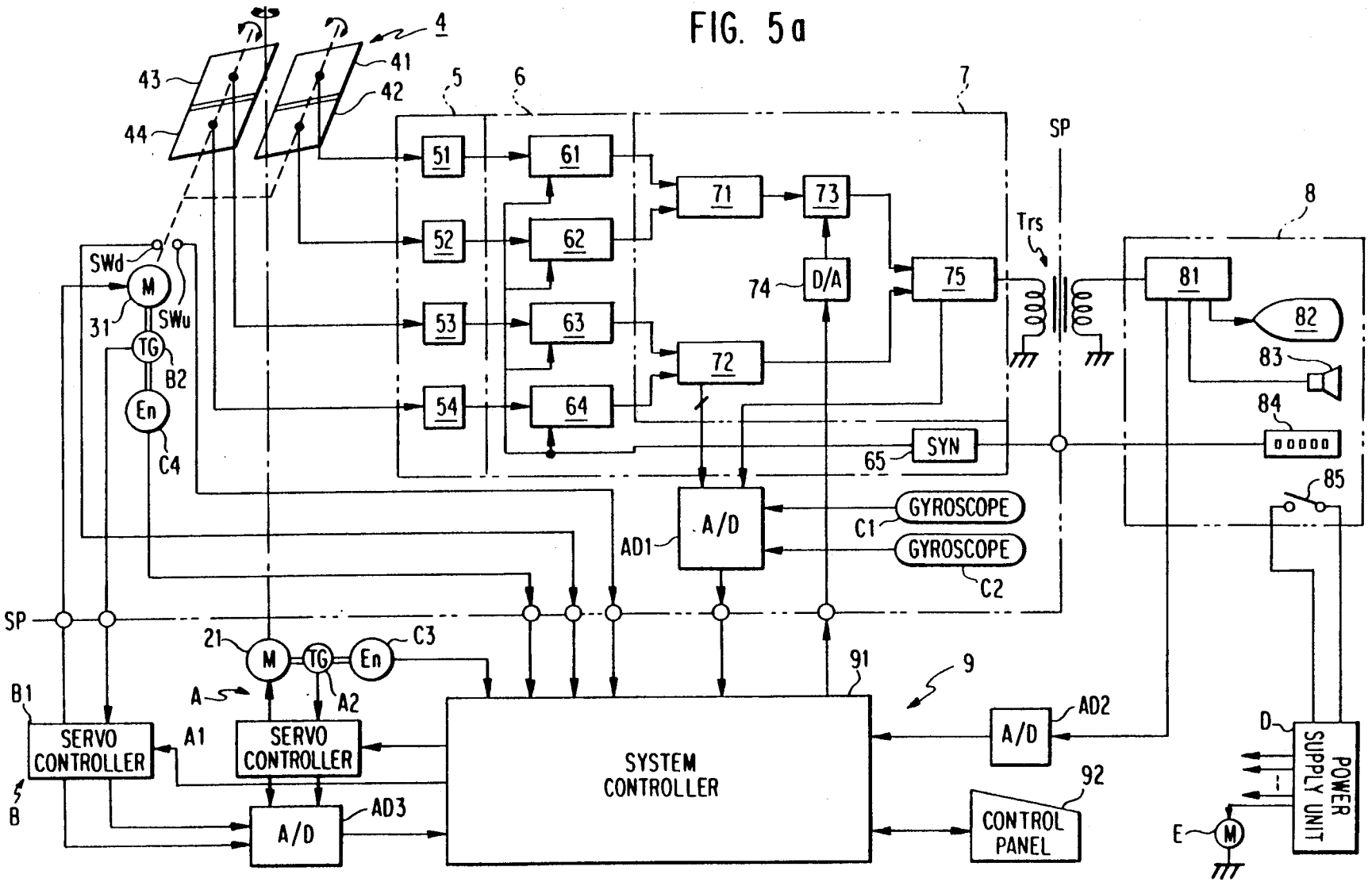
FIG. 5*a* is a block diagram showing the configuration of the control and signal processing systems of a second embodiment.

The configuration of the signal processing system according to this embodiment is illustrated in FIG. 5*a*. Antenna group 4, BS converter group 5 and BS tuner group 6 have not been changed, so for details thereof, refer to the description already provided in the foregoing.

The in-phase combining circuit group 7 includes in-phase combining circuits 71, 72 and 75, a phase shift circuit 73 and a D/A converter 74. In the in-phase combining circuit group 7 the outputs of the BS tuners 61 and 62 are combined in-phase and phase-shifted and the outputs of BS tuners 63 and 64 are in-phase combined, then the signals thus produced are combined in-phase.

The significance of the in-phase combining is the same as already described, so here the significance of the phase shifting will be described. Because the antenna carriages in the antenna apparatus have separate axes, the elevational rotation does not show up directly as a phase-shift in the signals received by the plane antennas 41 and 43 (or 42 and 44) Which are separated in the plane of elevational rotation. Because the elevation deflection angle $\phi$ cannot be detected directly from this phase difference, the received signals are phase-shifted and a state is created in which the plane antennas are treated as rotating about a single axis.

Figure 3C:
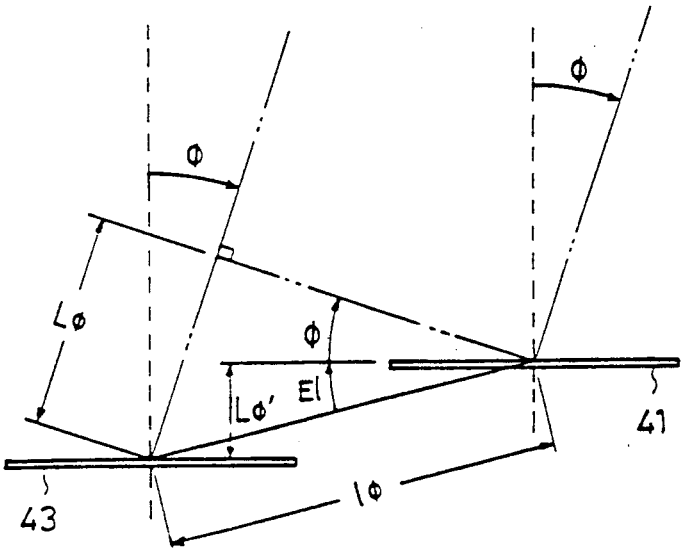

With reference to FIG. 3*c*, which is FIG. 3*b* redrawn to facilitate the explanation, if it is assumed that there is a broadcast satellite (which should be thought of as a projected plan image) in the direction in which the beams of the plane antennas 41 and 43 are oriented, the distance between the antenna 43 and the satellite will be more than the distance between the plane antenna 41 and the satellite by the amount of the vertical distance $L_\phi'$ between the antennas. Using the elevation angle E1, this vertical distance $L_\phi'$ can be represented by $l_\phi \cdot \sin$ E1, and the phase delay in the signal received by the plane antenna 43 with respect to the signal received by the plane antenna 41 is expressed as $2\pi \cdot l_\phi \cdot \sin E1/\lambda$.

Namely, if the signal received by the antenna 41 is delayed by this phase delay $2\pi \cdot l_\phi \cdot \sin E1/\lambda$, the phase difference between the signal received by the plane antenna 41 subsequent to the delay and the signal received by the plane antenna 43 can be considered as arising from elevation deflection angle $\phi$. After the in-phase combined output of the plane antennas 41 and 42 has been delayed by $2\pi \cdot l_\phi \cdot \sin E1/\lambda$ in the phase shift circuit 73, in the in-phase combining circuit 75 it is combined in-phase with the in-phase combined output of the plane antennas 43 and 44.

The in-phase combining circuit 71 is the same as the one used in the first embodiment and therefore requires no further explanation, except that in this embodiment the output is applied to terminal X' of the phase shift circuit 73.

Figure 5B:
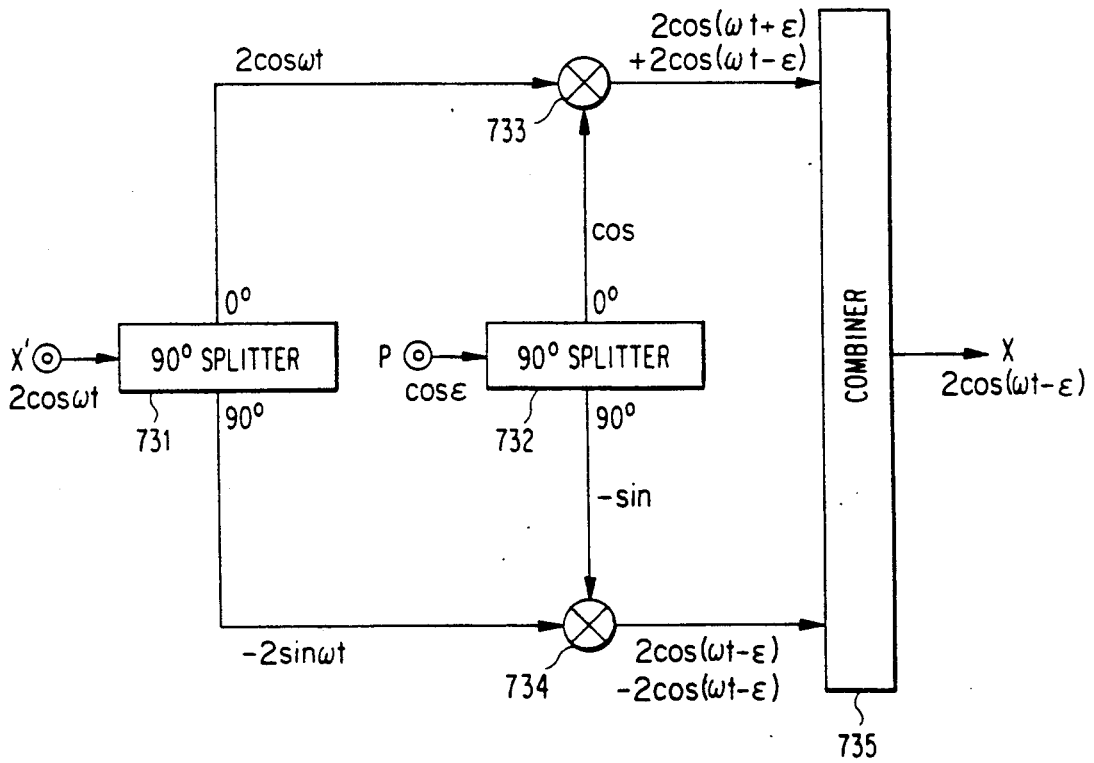
FIGS. 5*b* to 5*d* are block diagrams showing details of the configuration of FIG. 5*a;*

As show in FIG. 5*b*, the phase shift circuit 73 is constituted of 90° splitters 731 and 732, mixers 733 and 734 and a combiner 735, and shifts the phase of the signal 2 cos $\omega t$ output by the in-phase combining circuit 71 by the amount $2\pi \cdot l_\phi \cdot \sin E1/\lambda$ (hereinafter abbreviated as "$\epsilon$") based on the vertical distance $L_\phi'$ between the antennas, as described above.

Thus, a phase-shifted signal cos $\epsilon$ corresponding to the cosine of the phase difference $\epsilon$ is applied to terminal P. This is the signal corresponding to the elevation angle E1 of the antenna at that time output as digital data by the system controller 91 and converted to analog form by the D/A converter 74.

The signal 2 cos $\omega t$ input via the terminal X' is distributed by the 90° splitter 731 to mixers 733 and 734, and the signal cos $\epsilon$ input via terminal P also is distributed to mixers 733 and 734, by the 90° splitter 732.

Neither of the signal input to the mixer 733 is phase-shifted, so it performs the calculation 2 cos $\omega t \cdot \cos \epsilon$; each of the signals input to the mixer 734 has been phase-shifted, so the calculation 2 sin $\omega t \cdot \sin \epsilon$ is performed. The signals output by the mixers 733 and 734 are added by the combiner 735, which therefore outputs signal $\cos(\omega t - \epsilon)$ which is the output signal 2 cos $\omega t$ from the in-phase combining circuit 71 phase-shifted by $\epsilon$. This signal is input to the in-phase combining circuit 75.

Figure 5C:
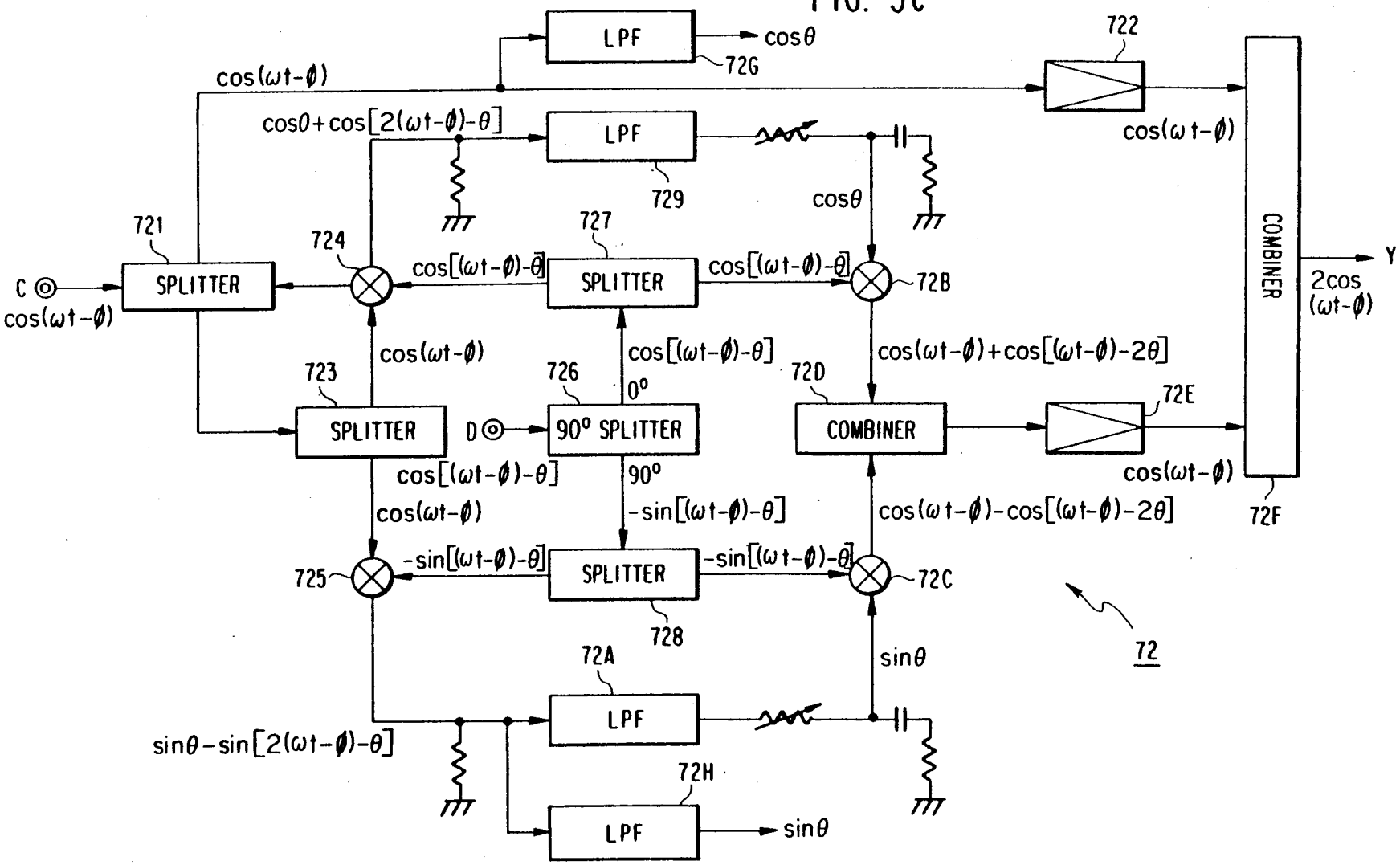

As shown in FIG. 5*c*, the in-phase combining circuit 72 has been provided with an extra low-pass filter 72G. In the same way as already described, the in-phase combining circuit 72 produces a signal $2\cos(\omega t-\Phi)$ by the in-phase combination of intermediate frequencies provided by the BS tuners 63 and 64, and extracts the cosine component $Vc_\theta$ and the sine component $Vs_\theta$ of the azimuth error voltage produced therebetween.

The azimuth error voltage cosine component $Vc_\theta$ is a DC signal $\cos\Theta$ obtained by the removal by the low-pass filter 72G of the AC component from the signal $-\cos(\omega t-\Phi)\cdot\cos(\omega t-\Phi-\Theta)$ output by the mixer 724. The sine component $Vs_\theta$ is a DC signal $\sin\Theta$ obtained by the removal by the low-pass filter 72H of the AC component from the signal $-\cos(\omega t-\Phi)\cdot\sin(\omega t-\Phi-\Theta)$ output by the mixer 724. The signals are converted to digital form by the A/D converter AD1 and are then output to the system controller 91 via a slip ring.

The phase difference $\Theta$ providing the azimuth error voltage cosine component $Vc_\theta$ and sine component $Vs_\theta$ is the phase difference between the signals received by the plane antennas 43 and 44 (which is the same as the phase difference between the signals received by the antennas plane antennas 41 and 42), and in accordance with the above explanation provided with reference to FIG. 3*a* is expressed as $2\pi\cdot l_\theta\cdot\sin\theta/\lambda$.

Figure 5D:
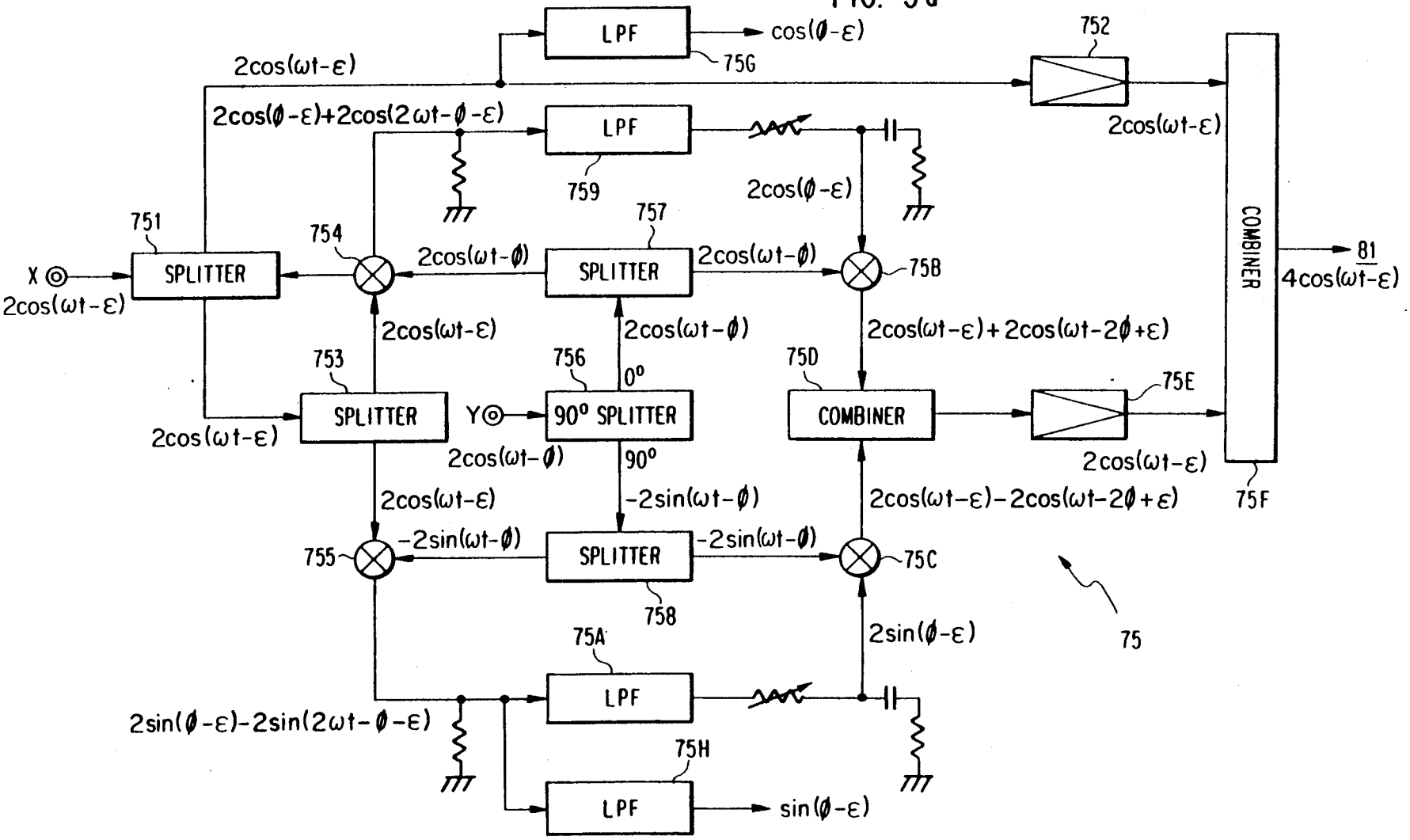

As shown in FIG. 5*d*, a low-pass filter 75G has been added to the in-phase combining circuit 75. The in-phase combining circuit 75 performs the in-phase combining of the outputs of the in-phase combining circuits 73 and 72 and extracts the cosine component $Vc_\phi$ and sine component $Vs_\phi$ of the elevation error voltage produced therebetween.

The in-phase combination of the signals is the same as that described with reference to the in-phase combining circuit 71, and can be applied here by substituting $(\omega t-\epsilon)$ for $\omega t$ and $(\Phi-\epsilon)$ for $\Theta$. This in-phase combining produces the signal $4\cos(\omega t-\epsilon)$. Here, the coefficient "4" signifies the combination of the signals received by the four plane antennas.

The elevation error voltage cosine component $Vc_\phi$ is a DC signal $\cos(\Phi-\epsilon)$ obtained by the removal by the low-pass filter 75G of the AC component from the signal $\cos(\omega t-\Phi)\cdot\cos(\omega t-\epsilon)$ output by the mixer 754. The sine component $Vs_\Phi$ is a DC signal $\sin(\Phi-\epsilon)$ obtained by the removal by the low-pass filter 75H of the AC component from the signal $-\cos(\omega t-\Phi)\cdot\sin(\omega t-\epsilon)$ output by the mixer 754. The signals are converted to digital form by the A/D converter AD1 and are then output to the system controller 91 via a slip ring.

The phase difference $(\Phi-\epsilon)$ providing the azimuth error voltage cosine component $Vc_\Phi$ and sine component $Vs_\Phi$ is the difference between the phase difference $\Phi$ between the signals received by the plane antennas 41 and 43 and the phase difference $\epsilon$ based on the vertical distance $L_\Phi'$ between plane antennas 41 and 43 (the same applying in the case of the relationship between antennas 42 and 44), and in accordance with the above explanation provided with reference to FIG. 3*c* is expressed as $2\pi\cdot l_\theta\cdot\sin\phi/\lambda-2\pi\cdot l_\theta\cdot\sin El/\lambda$.

The output of the in-phase combining circuit 75 is input to the television set 8 via an isolation type coupling transformer Trs: the functions and configuration are the same as those of the television set 8 of the first embodiment. An AGC signal taken off from the demodulator circuit 81 is converted to digital form by the A/D converter AD2 and input to the system controller 91.

The control system consists of a system control unit 9, an azimuth drive control unit A, an elevation drive control unit B, and various sensors, etc.

The azimuth drive control unit A is constituted of an azimuth servo controller A1 that controls the energizing of the azimuth motor 21 and a timing generator A2 connected to the azimuth motor 21. The azimuth servo controller A1 controls the energization of the azimuth motor 21 in accordance with a current value (positive-negative) corresponding to the rotation (forward-reverse) of the azimuth motor 21 detected by the timing generator A2 and a current reference value (positive-negative) provided by the system controller 91.

The elevation drive control unit B is constituted of the elevation servo controller B1 for controlling the energization of the elevation motor 31, and a timing generator B2 which is connected to the elevation motor 31. The elevation servo controller B1 controls the energization of the elevation motor 31 in accordance with a current value (positive-negative) corresponding to the rotation (forward-reverse) of the elevation motor 31 detected by the timing generator B2 and a current reference value (positive-negative) provided by the system controller 91.

The main sensors are gyroscopes C1 and C2, rotary encoders C3 and C4, limit switches SWu and SWd, and current sensors and angular velocity sensors (not shown). The gyroscopes C1 and C2 are mounted on the antenna carriage 12. Gyroscope C1 has azimuthal degrees of freedom and gyroscope C2 has degrees of freedom in the elevation direction; these gyroscopes output voltage signals corresponding to the angular velocity of deflections in the azimuthal and elevational directions caused by changes in attitude and movement of the car, for example. These signals are converted to digital form by the A/D converter AD1 and are then output to the system controller 91 via a slip ring.

The rotary encoder C4 is connected to the elevation motor 31 and detects the angle of rotation of the antenna carriages 11 and 12, meaning the angle of elevation, regarding up relative to the elevation reference line (the line connecting the centers of the plane antennas 41 and 43 or 42 and 44) as positive.

The limit switches SWu and SWd are both provided on the elevation drive 3 for detecting the upper and lower limits of the angle of elevation of the antenna beams. The upper limit is when the antenna beam is pointing up at an angle of 65° relative to the base 15, and the lower limit is a beam angle of 5°.

The current sensors and angular velocity sensors that are not illustrated are provided in the azimuth servo controller A1 and the elevation servo controller B1. These sensors detect the energizing current and the angular velocity of rotation of the azimuth motor 21 and elevation motor 31 as voltage signals, which are output to the system controller 91 via the A/D converter AD3.

The system control unit 9 is provided with the system controller 91 and a control panel 92, and is installed in the vehicle. The system control unit 9 controls satellite search and tracking operations in accordance with instructions input by an operator, via the control panel 92.

Figure 6A:
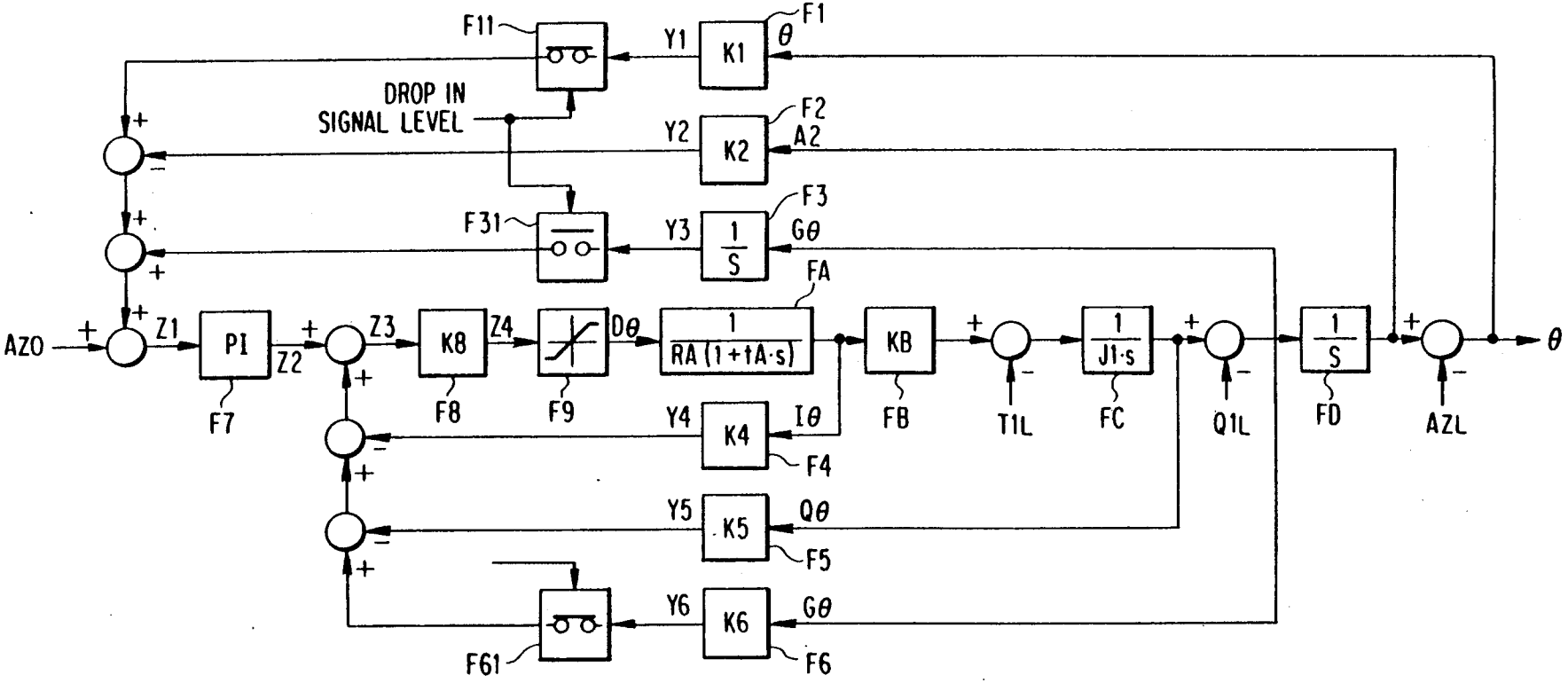
FIGS. 6*a* is a block diagram showing the operation of the second embodiment.

Attitude control of plane antennas 41 to 44 in accordance with the present embodiment will now be described with reference to the block diagram of FIG. 6*a*. Although FIG. 6*a* only illustrates azimuthal attitude control, elevational attitude control is effected in the same way, and as such drawings and description thereof are omitted.

For the purposes of explanation, it is assumed that a reference azimuth attitude control angle azo has been applied, the prescribed compensation carried out and the azimuth motor 21 energized by a current dst. Block FA is a motor 21 armature circuit, RA is an armature resistance and tA is an electrical time constant.

The energization causes a flow of current $I_\theta$ in the armature circuit, producing a torque at the output shaft of the azimuth motor 21 that is proportional to the armature current $I_\theta$. Thus, block FB is a proportional element, and constant KB denotes a torque constant. This torque is subjected to a torque disturbance t1L arising from the movement of the car, for example.

The torque generated in the motor 21 turns the swivel stand 13, updating the azimuth angle of the antenna beam. The angular velocity $Q_\theta$ at this time is proportional to the integral of the torque, and the azimuth angle update also is proportional to the integral. Block FC indicates a function of the former, and block FD a function of the latter. J1 is a proportional function derived from the inertia of the azimuth drive 2, swivel stand 13, and so forth.

The updated direction of antenna beam orientation will actually deviate from the direction of the satellite owing to the effect of angular velocity disturbance AzL caused by the movements of the car, for example. Accordingly, with the attitude control of antennas 41 to 44 using a current $D_\theta$ set on the basis of azimuthal attitude control reference azimuth angle $Az_o$, there will be deviation from the anticipated result owing to such factors as electrical crosstalk and disturbance caused by the movements of the car In the arrangement according to the present embodiment, therefore, an angular control loop, velocity control loop and current control loop have been provided.

The angular control loop provides feedback in the in-phase combining circuit 72 of azimuth angle deviation, i.e., azimuth deflection angle $\theta$, of the detected orientation of the antenna beam with respect to the direction of the satellite. However, because disturbance will be superposed on the orienting movement of the antenna beam, only the disturbance obtained by subtracting the azimuth angle Az, as detected by the rotary encoder C3, from this azimuth deflection angle $\theta$ is fed back. Blocks F1 and F2 are proportional elements and K1 and K2 are proportional constants.

However, an azimuth deflection angle $\theta$ cannot be obtained when the antennas 41 to 44 are not receiving any signals. For such cases, therefore, the integrated azimuthal angular velocity $G_\theta$ of the antennas 41 to 44 as detected by gyroscope C1 (hereinafter referred to as azimuthal gyro data) is employed instead of azimuth deflection angle $\theta$. Block F3 indicates this integral, and blocks F11 and F31 indicate changeovers thereof.

The velocity control loop compensates for angular velocity disturbance. For this, the angular velocity $Q_\theta$ of the motor 21, as detected by an angular velocity sensor, is subtracted from the azimuthal angular velocity of the plane antennas 41 to 44 that includes disturbance, that is, from the azimuthal gyro data $G_\theta$ of the gyroscope C1, thereby extracting just the disturbance, which is fed back. Blocks F5 and F6 are proportional elements, and K5 and K6 are the proportional constants thereof. When there is a drop in the signal level and gyro data $G_\theta$ are already being fed back by the angular velocity control loop, the superposition of gyro data $G_\theta$ is prevented by block F61.

The current control loop provides compensation for electrical loss in the motor 21 and the energizing circuitry on the basis of the motor 21 energizing current $I_\theta$ as detected by a current sensor. Block F4 is a proportional element, and K4 the proportional constant thereof.

In the control process, angular disturbance is compensated for by the angular control loop, using reference angle $Az_o$, to thereby obtain Z1; proportional-plus-integral compensation (proportional constant K7, time constant t7) is applied in block F7 to obtain Z2, and this is followed by angular velocity disturbance compensation by means of the velocity control loop and electrical loss compensation by means of the current control loop to obtain Z3. In block F8 (proportional constant K8) this value is converted to a current value corresponding to the update angle, which is used to energize the motor 21. Because the apparatus of the embodiment is installed in a car, it is necessary to protect the power source. For this, in block F4 the current limitation is applied to produce a current $D_\theta$ which is used to energize the motor 21. This means the addition of current limitation to the angular control loop that incorporates prcportional-plus-integral compensation (F7). However, because the velocity control loop and current control loop are configured inside the angular control loop, combining proportional-plus-integral compensation and current limitation does not lead to the production of windup.

Accordingly, therefore, because in this embodiment the velocity control loop and current control loop are configured inside the angular control loop, offset-free, high-speed control is realized and the power source is protected without windup being generated.

The above control processes are effected by the system controller 91. The control operations of the system controller 91 will now be described with reference to the flow charts of FIGS. 7*a* to 7*d*. When the main switch 85 is closed to supply the required voltage to each part of the system, in step 101 the system controller 91 initializes system memory, registers and flags. In step 102 the satellite search range is initialized. The search uses helical scanning, and at the start maximum and minimum elevation angle values are stored in the respective registers E1d and E1u to set full-range helical scanning.

Steps 103 to 105 form an input loop that waits for input from the control panel 92. When data indicating the region through which the car is travelling are input in this loop, the elevation of the satellite can be designated to a certain extent, so in step 104 the search range is set accordingly. When a start instruction is input via the control panel 92, the loop is interrupted and the process advances to step 106.

In step 106 the elevation angle of the plane antennas 41 to 44 is set to the search starting angle E1d (here and hereinbelow, this refers to the value in register E1d). Here, the elevation angle E1 as detected by the rotary encoder C4 is monitored while the elevation servo controller B1 is instructed to energize the elevation motor 31. When the elevation angle coincides with the search starting angle E1d, the elevation servo controller B1 is instructed to stop the energizing.

In step 107 the registers R1, Ra and Re used in the satellite search procedure are cleared, and in step 108 the azimuthal energizing current $D_\theta$ is set to the high value and the elevation energizing current $D_\phi$ is set to the low value, and the respective values are then output to the azimuth servo controller Al and elevation servo controller B1, and an instruction is issued to energize the azimuth motor 21 and the elevation motor 31. As a result, plane antennas 41 to 44 are caused to rotate continuously at high speed in the azimuth while changing the elevational attitude at low speed, causing the antenna beams to start helical scanning.

Following this, in steps 109 to 114, a search is made to establish the antenna attitude at which the received signal level is at a maximum. Namely, in step 110 the received signal level L (AGC signal) from the demodulator 81 is read and in step 111 the azimuth angle Az and elevation angle E1 detected by the rotary encoders C3 and C4 are read, and in step 112 the received signal level L at that time is compared with the maximum value of the received signal level up to that point stored in register R1. When the former is larger, in step 113 the azimuth angle Az, elevation angle E1 and the received signal level L at that point are stored in the respective registers Ra, Re and R1.

When helical scanning over the set range reaches completion, the elevation angle E1 will exceed a search termination angle E1u and in step 116 the search procedure is terminated by instructing the servo controllers to stop operation. At this point, register R1 contains the maximum value of the received signal level within the set search range, and registers Ra and Re contain the azimuth angle and elevation angle that produced the maximum value. In step 117 the value in register R1 and the minimum received signal level Lmin are compared. If there is no broadcast satellite in the helically-scanned search area, for example, the value in register R1 will fall below the minimum received signal level Lmin, in which case, in step 118, a "reception inoperative" indication will be given and the process will revert to step 103.

If radio waves transmitted by a broadcast satellite are received, the value in register R1 will exceed the minimum received signal level Lmin and in step 119 the antennas will be set to the attitude indicated by the values in registers Ra and Re. This is done by monitoring the azimuth angle Az and elevation angle E1 detected by the rotary encoders C3 and C4 while the motors 21 and 31 are controlled by the azimuth servo controller Al and elevation servo controller B1.

When the antennas are set to the attitude that provides the maximum received signal level, in step 120 the azimuth angle Az and elevation angle E1 are again read, and in step 121 these angles are stored in the respective registers $Az_o$ and $E1_o$ as a reference azimuth angle and a reference elevation angle.

Following this, in step 122 the registers Aq−, Acw, Accw, Eq−, Ecw and Eccw employed in the correction of the azimuth error voltage and elevation error voltage, described below, are cleared, and in the loop formed by steps 123 to 144 the attitude control of the plane antennas 41 to 44 is performed in accordance with the control loops illustrated in FIG. 6*a*.

With respect to tracking, in step 124 azimuth angle Az and elevation angle E1 are read and in step 125 the phase difference $\epsilon$ produced by the vertical distance $L_\phi'$ between the antennas 41 and 43 and the antennas 42 and 44 at the elevation angle E1 are read out from a ROM lookup table and output. These data are converted to voltage values by a D/A converter 74 and applied to the phase shift circuit 73, shifting the combined received signals of antennas 41 and 43.

In steps 126 to 129, the received signal level L is read, and if the value exceeds the minimum received signal level Lmin a "1" is stored in register A, while if the value is below Lmin a "0" is stored in register A. This register A value is employed for shifting the control parameters described above (blocks F11, F31 and F61).

In step 130, azimuth motor 21 energizing current $I_\theta$ and elevation motor 31 energizing current $I_\phi$ are read; in step 131 azimuth motor 21 angular velocity $Q_\theta$ and elevation motor 31 angular velocity $Q_\phi$ are read; and in step 132 the azimuthal angular velocity of antennas 41 to 44 which include disturbance, i.e., gyro data $G_\theta$, and the elevational angular velocity of the antennas 41 to 44 that includes disturbance, i.e., gyro data $G_\phi$, are read.

In step 133, the azimuth error voltage cosine component $Vc_\theta$ and sine component $Vs_\theta$ and the elevation angle a error voltage cosine component $Vc_{100}$ and sine component $Vs_\phi$ are read. As has been described, azimuth error voltage cosine component $Vc_\theta$ is DC cos $\Theta$ and sine component $Vs_\theta$ is DC component sin $\Theta$, and elevation angle error voltage cosine component $Vc_\phi$ is DC component $\cos(\Phi-\epsilon)$, and sine component $Vs_\phi$ is $\sin(\Phi-\epsilon)$. In accordance with the explanation provided with reference to FIG. 3*a*, $\Theta$ is represented by $2\pi\cdot l_\theta\cdot\sin\theta/\lambda$, and in accordance with the explanation provided with reference to FIG. 3*b*, $(\Phi-\epsilon)$ is represented by $2\pi\cdot l_\theta\cdot\sin\phi/\lambda-2\pi\cdot l_\theta\cdot\sin El/\lambda$. That is, each of the components $Vc_\theta$, $Vs_\theta$, $Vc_\phi$ and $Vs_\phi$ become Bessel functions.

In FIG. 8*a*, curve C is the azimuth error voltage cosine component $Vc_\theta$ and curve S is the sine component $Vs_\theta$. Regarding curve S, when the azimuth deflection angle is 0° the voltage will be 0 [mV], so if the azimuth error voltage cosine component $Vc_\theta$ is fed back, it would appear that the broadcast satellite (radio wave source) could be tracked automatically, but when the component is fed back without modification automatic tracking will be limited to a range $-180° < \Theta < +180°$. That is, within the range TP(−1) to TP(+1) it is possible to home in on the normal stable point SP(0), but outside this range the system will home in on pseudo stable points. For example, in the range TP(+1) to TP(+2) the system will be drawn to pseudo stable point SP(+1) and in the range TP(−1) to TP(−2) it will be drawn to pseudo stable point SP(−1).

In the apparatus of this embodiment TP(−1) is about −2.2° and TP(+1) is about +2.2°. As shown by the curve P depicting the (combined) antenna beam, because the half-value angle of the antenna beam is outside this lead-in range, whether the beam will be drawn to a pseudo stable point can be fully anticipated. To prevent it happening, in this apparatus the azimuth deflection angle quadrant is set from the azimuth error voltage cosine component $Vc_\theta$ and sine component $Vs_\theta$, the sign of the sine component $Vs_\theta$ is corrected accordingly, obtaining the azimuth error voltage $V_\theta$ which is fed back.

Figure 8B:
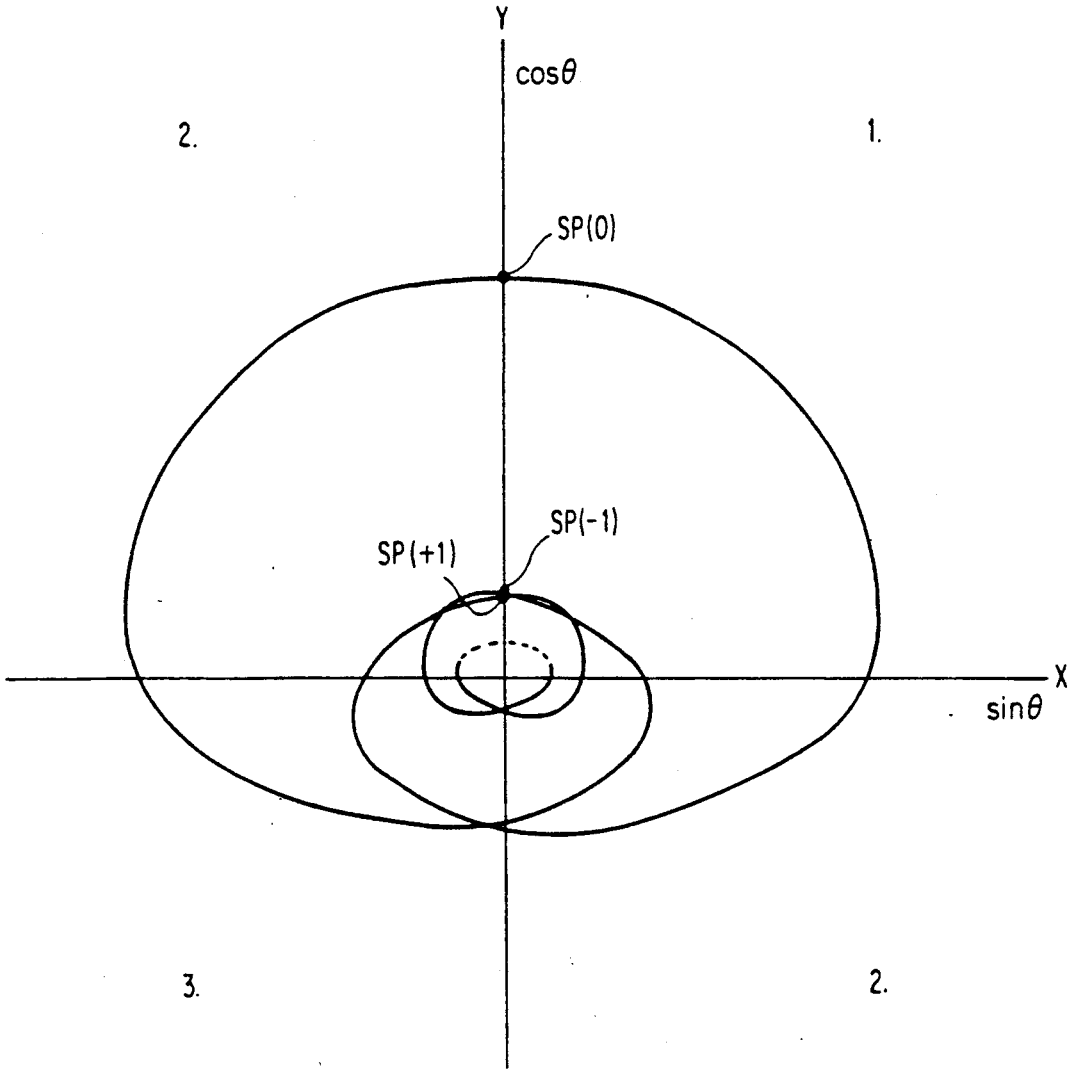
FIG. 8*b* is a graph showing the phase of the azimuth deflection angle as a function of the azimuth error voltage cosine and sine components.

More specifically, as shown in FIG. 8*b*, quadrants I to IV are set, for the azimuth error voltage cosine component $Vc_\theta$ on the y-axis and the sine component $Vs_\theta$ on the x-axis. The graph is a map of the cosine component $Vc_\theta$ and sine component $Vs_\theta$ shown in FIG. 8*a*. On this graph, a positive change in the azimuth deflection angle is a clockwise motion from stable point SP(0); and conversely, a negative change in the azimuth deflection angle is a counterclockwise motion from stable point SP(0). Therefore while tracing changes in the azimuth deflection angle, the sign of the sine component $Vs_\theta$ to cause the angle to return is corrected, thereby obtaining the azimuth error voltage $V_\theta$.

As the procedure used to obtain the elevation angle error voltage $V_\theta$ is the same, illustrations and descriptions thereof are omitted to avoid repetition.

The correction process described above is performed in step 134, and will now be described with reference to the flow chart of FIG. 7*d*. In step 201 the azimuth deflection angle quadrant is obtained from the azimuth error voltage cosine component $Vc_\theta$ and sine component $Vs_\theta$, and in step 202 the quadrant is stored in register Aq. The register $Aq_-$ holds the preceding quadrant (or zero, at the outset), and if the two are different, in step 204 the values in these registers are examined.

A value in register $Aq^-$ indicating quadrant I and a value in register Aq indicating quadrant II would signify clockwise changes in the azimuth deflection angle (here and below, meaning with reference to FIG. 8*b*). In this case it is necessary to differentiate between clockwise change from the stable point SP(0) and clockwise change in the course of a return after a counterclockwise change from the stable point SP(0). This can be done by examining the value in counterclockwise register Accw that counts counterclockwise turns. A value of zero would at least signify the completion of a return following past counterclockwise changes, and accordingly, in step 206 the count in the clockwise register Acw for counting clockwise turns would be incremented by one.

In the same way, a value in register $Aq^-$ indicating quadrant II and a value in register Aq indicating quadrant I would signify counterclockwise changes in the azimuth deflection angle, in which case, provided that the value in the counterclockwise register Accw is zero, in step 208 the count in the clockwise register Acw would be decremented by one. A value in register $Aq^-$ indicating quadrant III and a value in register Aq indicating quadrant IV would signify clockwise changes in the azimuth deflection angle, in which case, provided that the value in the clockwise register Acw is zero, in step 210 the count in the counterclockwise register Accw would be decremented by one. A value in register $Aq^-$ indicating quadrant IV and a value in register Aq indicating quadrant III would signify counterclockwise changes in the azimuth deflection angle, in which case, provided that the value in the clockwise register Acw is zero, in step 212 the count in the counterclockwise register Accw would be incremented by one.

In step 213, when the azimuth deflection angle quadrant changes, including in cases other than the above, the current quadrant in register Aq is stored in register $Aq^-$.

Accordingly, when the azimuth deflection angle has undergone clockwise change the value in the clockwise register Acw will be at least one, and when the change is counterclockwise the value in the counterclockwise register Accw will be at least one. Thus, if the clockwise register Acw value is one or more and the current azimuth deflection angle quadrant is quadrant III or IV, in step 216 the sign of the azimuth error voltage sine component $Vs_\theta$ is changed and the azimuth error voltage $V_\theta$ is set; in the same way, if the counterclockwise register Accw value is one or more and the current azimuth deflection angle quadrant is quadrant I or II, in step 219 the sign of the azimuth error voltage sine component $Vs_\theta$ is changed and the azimuth error voltage $V_\theta$ is set. In other cases, the azimuth error voltage $V_\theta$ is set by azimuth error voltage sine component $Vs_\theta$ in step 220. This makes it possible to home in correctly on the stable point SP(0) even when the change in azimuth deflection angle exceeds the above range TP(−1) and TP(+1) and the azimuth error voltage sine component $Vs_\theta$ alternates.

In step 221 the elevation angle error voltage $V_\phi$ is set. As the procedure is identical to that of steps 210 to 220 described above, there is no separate description.

Figure 7A:
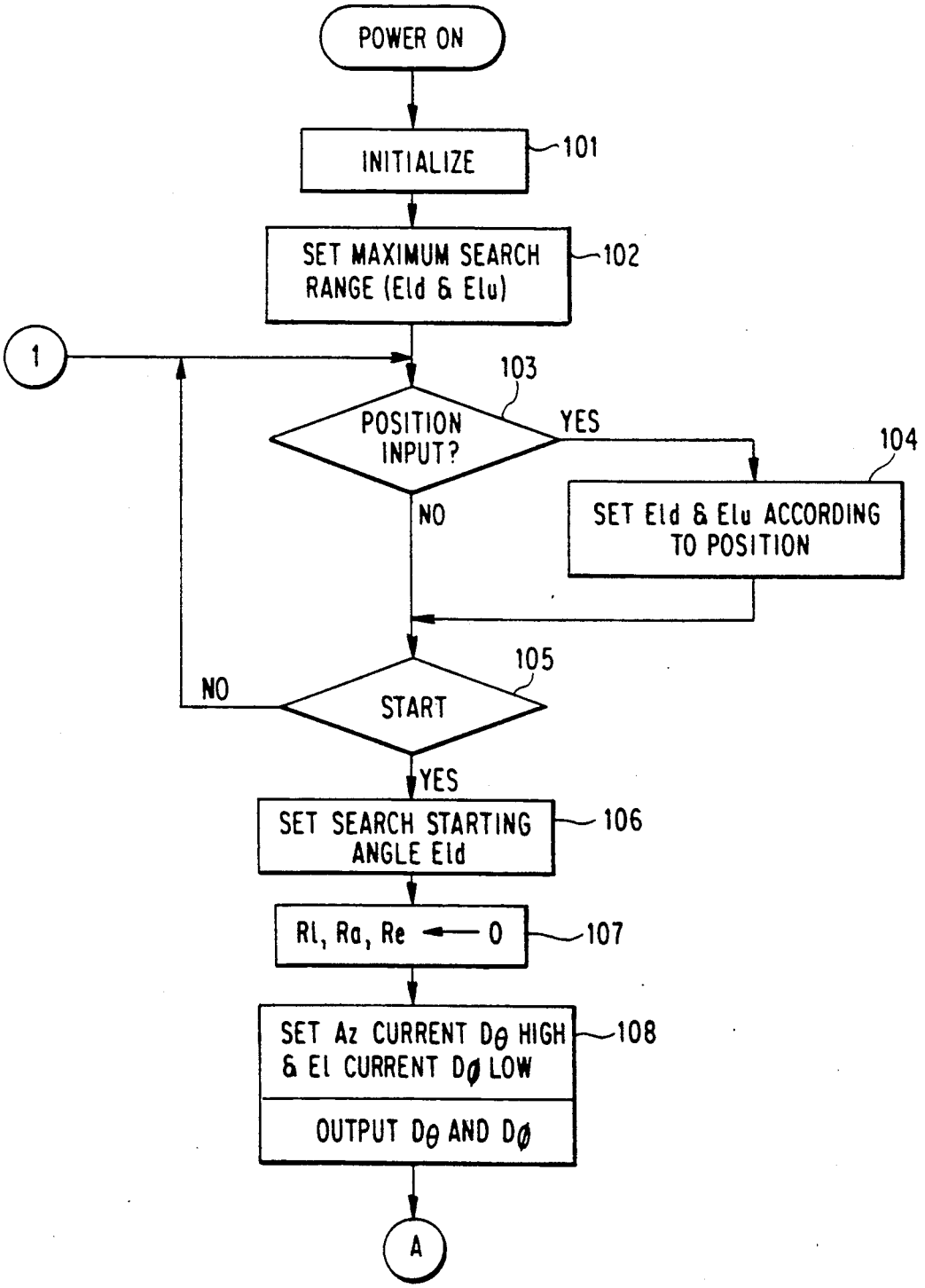
Figure 7B:
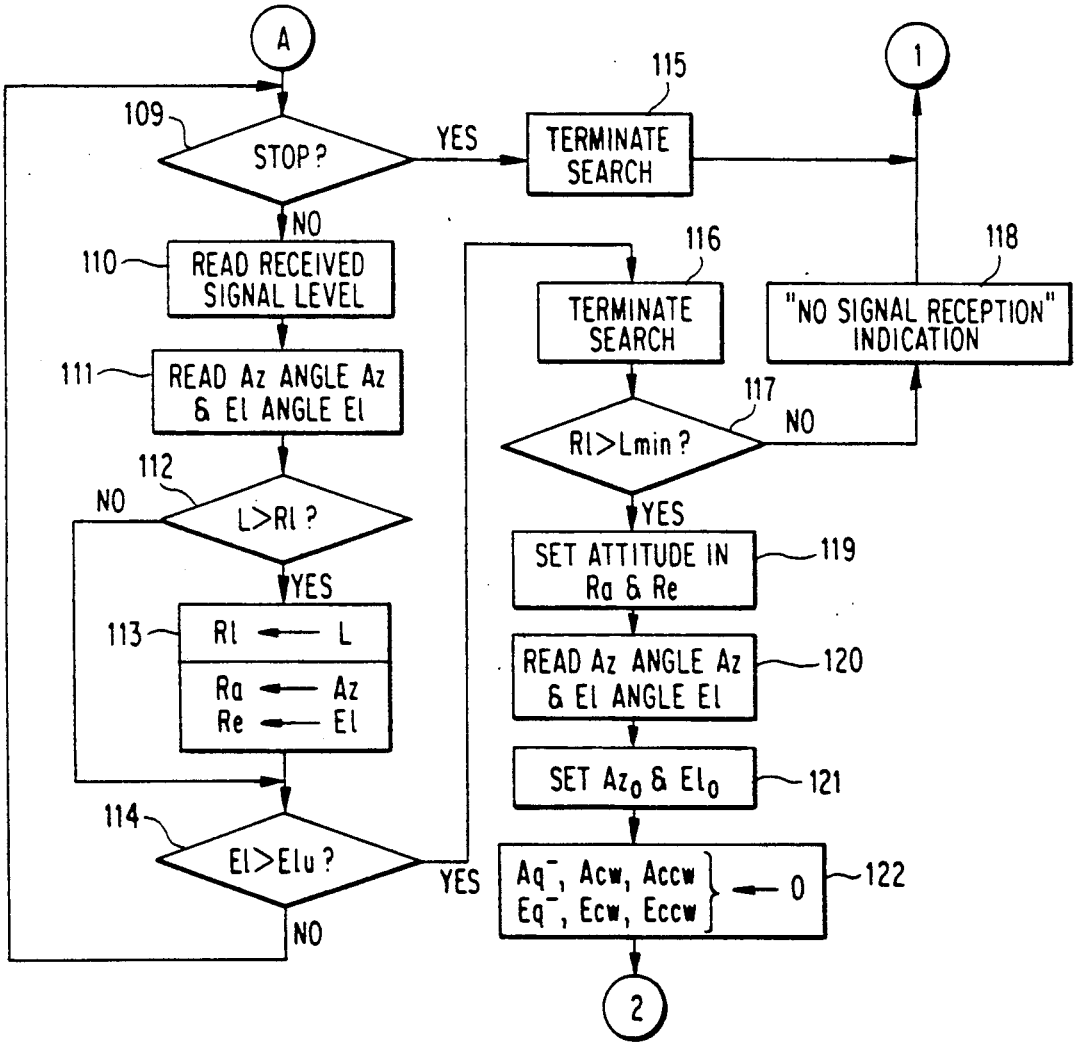
Figure 7C:
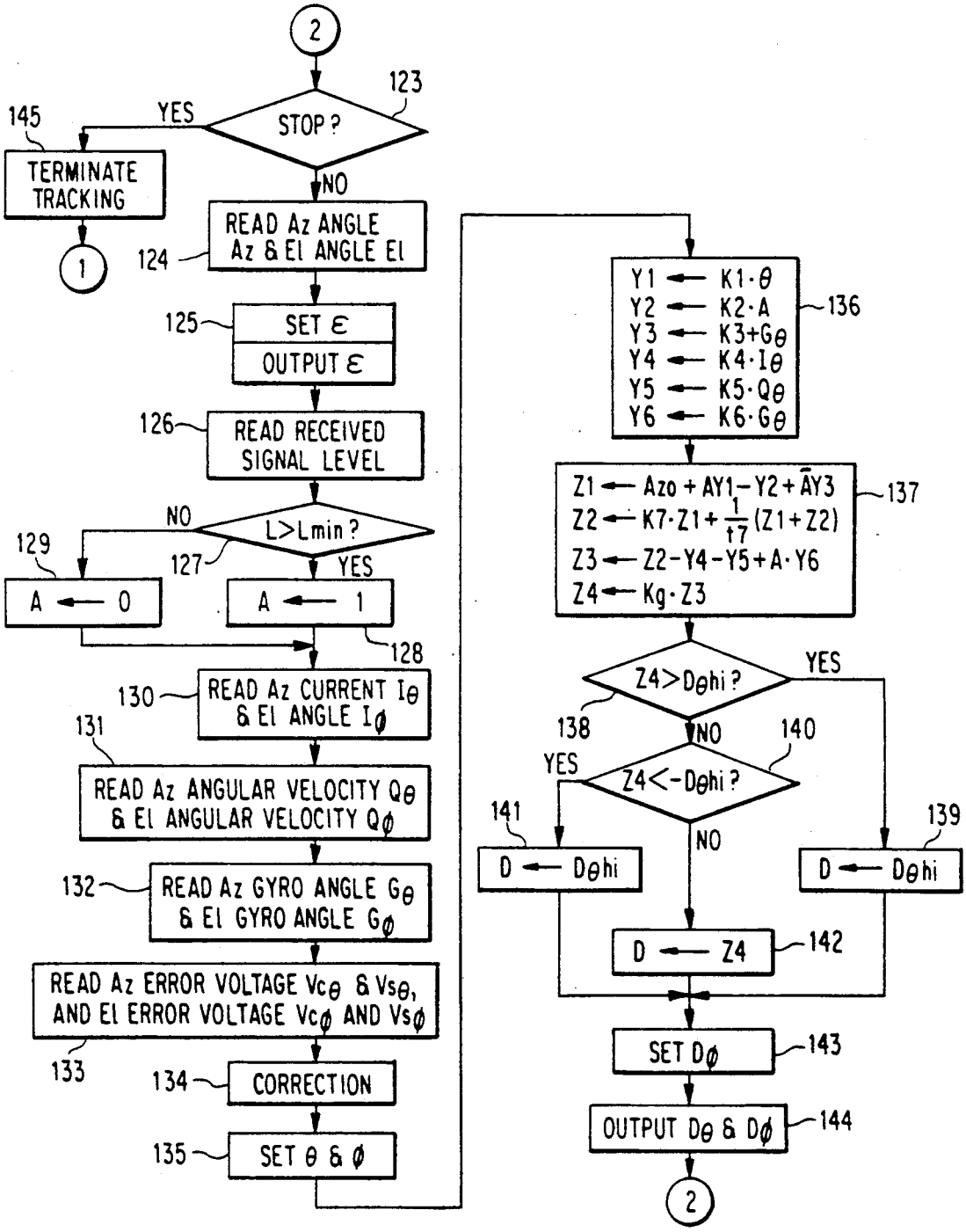
Figure 7D:
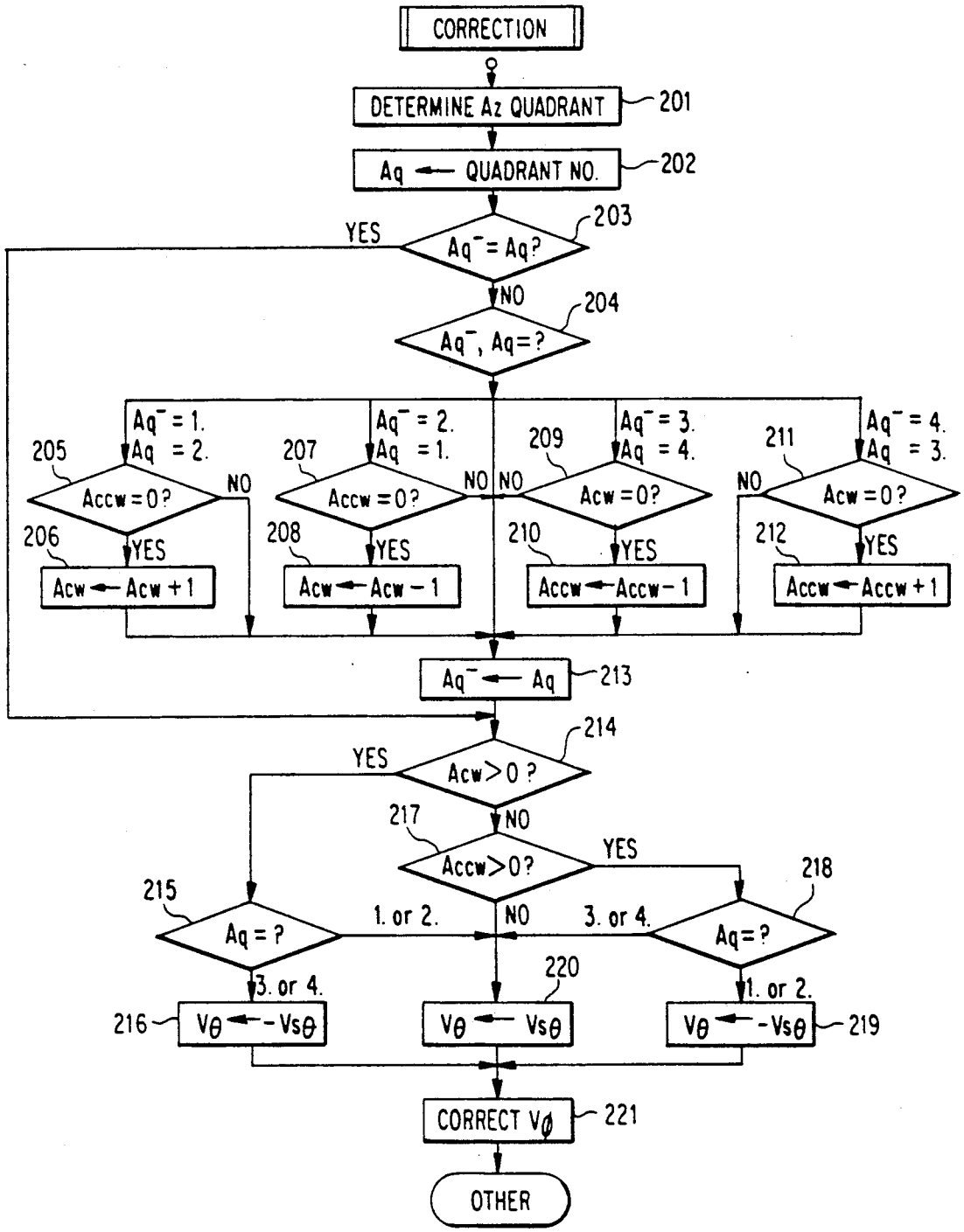

Following on, in step 135 of the flow chart of FIG. 7*c* the values of azimuth error voltage $V_\theta$ and elevation error voltage $V_\theta$ are used to check a ROM lookup table to obtain azimuth deflection angle $\theta$ and elevation deflection angle $\phi$. In step 136 azimuth deflection angle $\theta$, azimuth angle Az, azimuth gyro data $G_\theta$, azimuth motor 21 energizing current $I_\theta$ and angular velocity $Q_\theta$ are used to obtain the control parameters Y1 to Y6 in the feedback described above. Namely, azimuth deflection angle $\theta$ is multiplied by constant K1 and stored in register Y1; azimuth angle Az is multiplied by constant K2 and stored in register Y2; gyro data $G_\theta$is integrated using the sum component method and stored in register Y3; energizing current $I_\theta$ is multiplied by constant K4 and stored in register Y4; angular velocity $Q_\theta$ is multiplied by constant K5 and stored in register Y5; and gyro data $G_\theta$ is multiplied by constant K6 and stored in register Y6.

In step 137, the angular disturbance compensation effected by the angular control loop is applied to reference angle $Az_o$ to obtain the aforementioned Z1, which is subjected to proportional integration to obtain Z2, which is subjected to angular disturbance compensation by the velocity control loop and electrical loss compensation by the current control loop to obtain Z3, which is converted to a motor 21 energizing current value to obtain Z4.

In this case, in the angular disturbance compensation, if the register A value is 1, the difference between parameters Y1 and Y2 is added to reference angle $Az_o$, and if the register A value is 0 the difference between parameters Y3 and Y2 is added to reference angle $Az_o$ (overlines signify negative).

If angular disturbance compensation and electrical loss compensation are performed simultaneously and parameter Y4 is subtracted from the Z2 obtained by the proportional integration of Z1, when the register A value is 1 the difference between parameters Y6 and Y5 is added, while if the register A value is 0, only parameter Y5 is added.

The current limitation described above is performed in steps 138 to 142. After the various compensations have been carried out the reference azimuth angle converted to the motor 21 energizing current value Z4 is adjusted to or above a maximum reverse energizing current $-D_{74}$ hi and to or below a maximum forward energizing current $D_\theta$ hi to set azimuth energizing current $D_\theta$.

In step 143 the same procedure is used to set the elevation energizing current $D_\phi$, and in step 144 energizing currents $D_{74}$ and $D_\phi$ are output to the azimuth servo controller A1 and the elevation servo controller B1, instructions are issued to energize the motors 21 and 31 and the process returns to step 123.

The aforementioned procedures can be stopped temporarily by inputting a stop instruction via the control panel 92. When a stop instruction is input during helical scanning, in step 115 the search process is terminated and the process returns to step 103. Also when a stop instruction is input during tracking control, in step 145 the tracking process is terminated and the process returns to step 103.

With reference to a variation of the second embodiment, in the attitude control it was found that offset could be eliminated without using proportional-plus-integral compensation processing by making the relationship between proportional constants K1 and K2: K2= −K1, and that between proportional constants K5 and K6: K6= −K5.

Figure 6B:
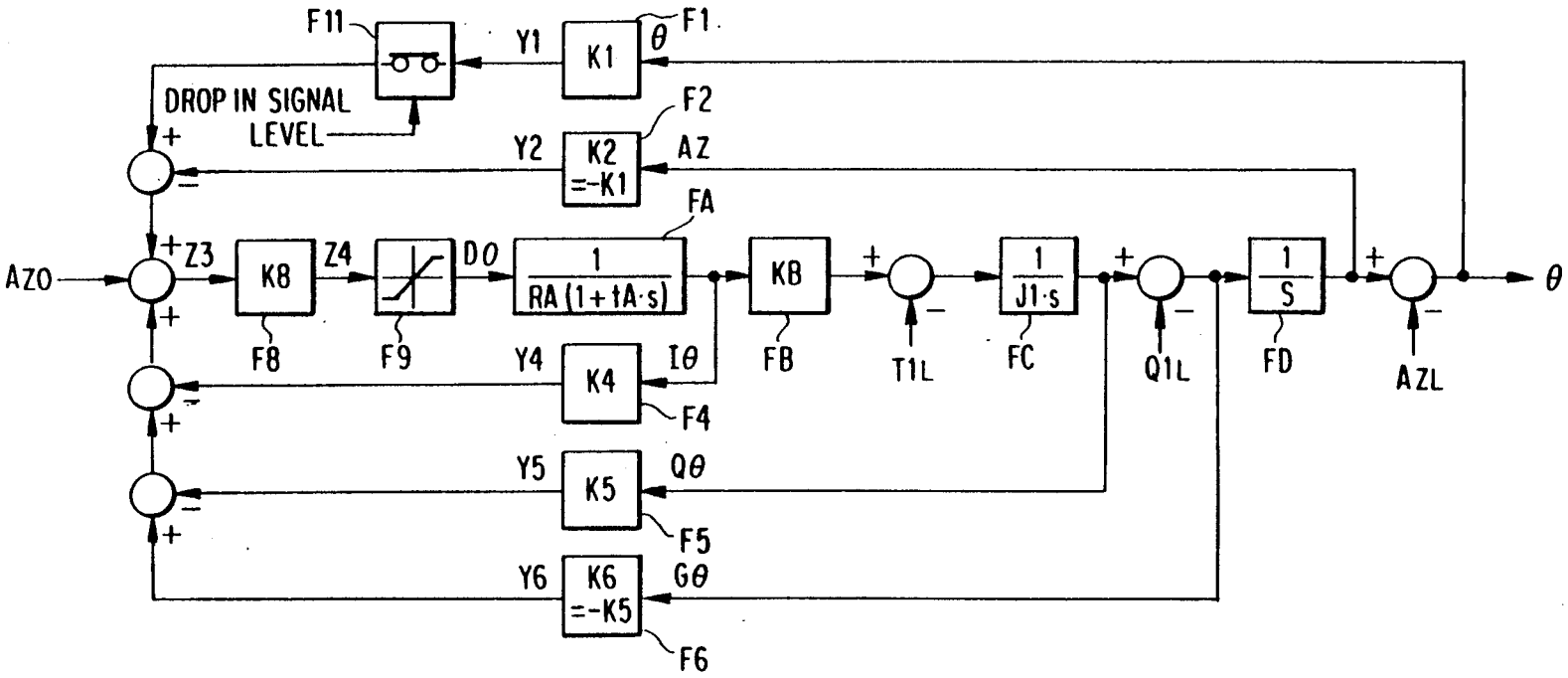
FIG. 6*b* is a block diagram showing a modified version of the second embodiment.

The block diagram of FIG. 6*b* illustrates an attitude control arrangement based on this. As shown in FIG. 6*b*, the proportional-plus-integral procedure indicated in FIG. 6*a* by block F7 is omitted as well as the integration of gyro data $G_\theta$ shown by block F3. Instead, the process is based on the agreement between the points of action (the points at which compensation is effected) of the angular, velocity, and current control loops. Accordingly, with the only changeover being F11, control is simplified.

Specifically, of the control operations performed by the system controller 91, the procedures of steps 134 and 135 shown in the flow chart of FIG. 7*c* are simplified. In step 134, it becomes unnecessary to calculate control parameter Y3, and instead of the calculations used in the same step to obtain Z1, Z2 and Z3, 103 Z3 is obtained directly by the calculation $Az_o$+Ayl−Y2−. Y4−Y5+Y6. As there are no other changes, there is no separate flow chart.

To summarize, the attitudes of two antennas separated in the plane of elevational rotation are changed independently while the beams are maintained parallel; and by shifting the phase of the signals received by one of the antennas by a phase corresponding to the distance between the radiation points of the antennas projected on an arbitrary line that is parallel to each beam, it becomes possible to detect the direction of arrival of a radio wave from the difference in the phase of the signals received by each antenna. Because a multiplicity of antennas are driven as independent members, inertia of the moving parts is decreased and it becomes much easier to decrease the size of the apparatus. Especially when plane antennas are used, the division of the antennas enables a three-dimensional operating range to be made smaller, which in turn enables full use to be made of the low profile nature of the system.

The phase differences between the signals received by the antennas are extracted as mutually orthogonal functions (cosine and sine functions), and based on the signs thereof, the phase of the deflection angle of the antenna beams with respect to the direction of the radio waves is divided into a multiplicity of quadrants, for example four, and by correcting the phase difference between the signals received by the antennas extracted by retracing back through changes in the quadrants from a past point up to the present, pointing error caused by the effect of pseudo stable points can be eliminated completely.

In the attitude control process, data showing disturbance are obtained and energizing data are compensated accordingly, thereby eliminating the possibility that the effects of the disturbance may cause the drive means energization level to set too high or too low, thereby improving control stability.

Disturbance data are obtained as a multiplicity of systems for compensating the energizing data and the compensation can be performed using any of the systems that is sound, which increases the reliability of the attitude control. Also, detecting intensity information that shows the intensity of the energizing force actually applied to the drive means and compensating energizing data accordingly enables &:he correct energizing information to be set even if there is an anomaly in the disturbance-based compensation, thereby increasing the reliability of the attitude control stability.

Specifically, in the second embodiment integrating elements are added to the disturbance-derived energizing data compensation loop, to prevent offset and improve the high-speed response characteristics. Also, with the aim of preventing over-energization of the drive means caused by compensation anomaly, the energizing data contain limitations. However, even if, owing to an anomaly in the disturbance-based compensation, the effect of the limitation is manifested as a lowering of the energizing force, system stability is maintained by compensation based on intensity data, effectively preventing windup in the compensation loops that include integrating elements.

While the invention has been described with reference to preferred embodiments, it will be understood by those skilled in the art that various changes may be made and equivalents may be substituted for elements thereof without departing from the scope of the invention. For example, the invention could be applied without change to robot attitude control; or to the detection of the bearings of an object based on signals received from the object; or control that is required in only one direction could be provided by selecting that part of the control system concerned; or using geomagnetic sensors or suchlike in place of gyroscopes. In addition, many other modifications may be made to adapt a particular situation or material to the teachings of the invention without departing from the essential scope thereof. Therefore, it is intended that the invention should not be limited to the particular embodiments disclosed as the best mode contemplated for carrying out the invention, but that the invention will include all embodiments falling within the scope of the appended claims.

What is claimed is:

1. An antenna apparatus comprising:

first, second and third receiving antennas;

support means for supporting the first, second and third receiving antennas so that the antennas are movable in a first direction and in a second direction that is orthogonal to the first direction while the radiation lobes of the antennas are maintained parallel, and a plane that includes the radiation lobes of the first and second receiving antennas is maintained perpendicular to a plane that includes the radiation lobes of the first and third receiving antennas;

first drive means for driving the first, second and third receiving antennas in the first direction;

second drive means for driving the first, second and third receiving antennas in the second direction;

first phase detection means for detecting a first phase difference signal corresponding to a phase difference between a signal received by the first receiving antenna and a signal received by the second receiving antenna;

second phase detection means for detecting a second phase difference signal corresponding to a phase difference between a signal received by the first receiving antenna and a signal received by the third receiving antenna; and control means for obtaining the direction of a radio wave source on the basis of the first and second phase difference signals and controlling the respective energization of the first and second drive means.

2. An antenna apparatus according to claim 1 provided with in-phase combining means for in-phase combining of signals received by at least two receiving antennas selected from among the first, second and third receiving antennas.

3. An antenna apparatus comprising:

a first antenna group that includes a first and second receiving antennas;

a first support means for supporting the first antenna group so it can move in a first direction while the radiation lobes of the first and second receiving antennas are maintained parallel;

a second antenna group that includes a third receiving antenna;

a second support means for supporting the second antenna group so that it is movable in a first direction while maintaining the radiation lobes of the third receiving antenna parallel to the radiation lobes of the first and second receiving antennas, and maintaining the plane that includes the radiation lobes of the first and third receiving antennas perpendicular to a plane that includes the radiation lobes of the first and second receiving antennas;

first drive means for driving the first and second antenna groups in the respective first direction;

third support means for supporting the first and second antenna groups, the first and second support means and the first drive means so that said first and second antenna groups, first and second support means and first drive means are movable in a second direction that is orthogonal to the first direction;

second drive means for driving the first and second antenna groups, the first and second support means and the first drive means in the second direction as a consolidated body;

first phase detection means for detecting a first phase difference signal corresponding to a phase difference between a signal received by the first receiving antenna and a signal received by the second receiving antenna;

second phase detection means for detecting a second phase difference signal corresponding to a phase difference between a signal received by the first receiving antenna and a signal received by the third receiving antenna; and control means for obtaining the direction of a radio wave source on the basis of the first and second phase difference signals and controlling the respective energization of the first and second drive means.

4. An antenna apparatus according to claim 3 provided with in-phase combining means for in-phase combining of signals received by at least two receiving antennas selected from among the first, second and third receiving antennas.

5. A method of controlling receiving antenna attitude comprising rotating a first receiving antenna about a first axis and a second receiving antenna about a second axis which is parallel to the first axis while maintaining the beams of the first and second receiving antennas parallel; and shifting the phase of the signal received by the first receiving antenna by a phase corresponding to the distance between projected points obtained when a point that is substantially the beam radiation point of the first receiving antenna and a point that is substantially the beam radiation point of the second receiving antenna are projected onto a single arbitrary line that is parallel to each beam, obtaining the direction of the radio wave source and setting the attitude of the first and second receiving antennas on the basis of the phase difference between the signal received by the first receiving antenna subsequent to the shift and the signal received by the second receiving antenna.

6. A receiving antenna attitude control apparatus comprising:

first and second receiving antennas;

a first support means for supporting the first receiving antenna so the attitude thereof can be changed in a first direction;

a second support means for supporting the second receiving antenna separately from the first receiving antenna so the attitude of the second receiving antenna can be changed in a second direction that is similar to the first direction;

drive means for driving the first receiving antenna in the first direction and the second receiving antenna in the second direction while the beams of the first and second receiving antennas are maintained parallel;

a first detecting means for detecting the distance between projected points obtained when a point that is substantially the beam radiation point of the first receiving antenna and a point that is substantially the beam radiation point of the second receiving antenna are projected onto a single arbitrary line that is parallel to each beam;

phase shifting means for shifting the phase of the signal received by the first receiving antenna by a phase corresponding to the said distance;

second detection means for detecting the phase difference between the signal received by the first receiving antenna subsequent to the shift and the signal received by the second receiving antenna; and control means for obtaining the direction of the radio wave source on the basis of said phase difference and controlling the energization of the drive means.

7. A method of controlling receiving antenna attitude when the first and second receiving antennas whose attitude is changeable are driven to orient them toward a radio wave source while maintaining beams of the antennas parallel, comprising:

multiplying together the signal received by the first receiving antenna and the signal received by the second receiving antenna and extracting the phase difference between the signals as a first function; multiplying together the signal received by the first receiving antenna and the signal received by the second receiving antenna phase-shifted 90 degrees and extracting the phase difference between the signals as a second function orthogonal to the first function;

dividing the phase of the angle of deflection of the beams of the first and second receiving antennas with respect to the direction of the radio wave source into a multiplicity of quadrants based on the sign of the phase difference extracted as a first function and the sign of the phase difference extracted as a second function;

while monitoring changes in the phase of the angle of deflection, correcting at least one of the phase difference extracted as a first function and the phase difference extracted as a second function on the basis of preceding phase quadrants and current phase quadrants, and setting the attitudes of the first and second receiving antennas on the basis of the corrected phase difference.

8. A receiving antenna attitude control apparatus comprising:

support means for supporting first and second receiving antennas so the attitude thereof can be changed;

drive means for driving the first and second receiving antennas while maintaining the beams thereof parallel;

first phase difference extraction means for multiplying together the signal received by the first receiving antenna and the signal received by the second receiving antenna and extracting the phase difference between the signals as a first function;

phase shifting means for shifting the phase of the signal received by the second receiving antenna 90 degrees;

second phase difference extraction means for multiplying together the signal received by the first receiving antenna and the signal received by the second receiving antenna and extracting the phase difference between the signals as a second function orthogonal to the first function;

control means for dividing the phase of the angle of deflection of the beams of the first and second receiving antennas with respect to the direction of the radio wave source into a multiplicity of quadrants based on the sign of the phase difference extracted as a first function and the sign of the phase difference extracted as a second function, storing each change of a prescribed extent in the deflection angle phase quadrant, correcting at least one of the phase difference extracted as a first function and the phase difference extracted as a second function on the basis of the stored preceding phase quadrants and current phase quadrants, and energizing the drive means in a direction in which the corrected phase difference approaches a prescribed value.

9. An attitude control method in which drive means are linked to a control object the prescribed attitude of which can be changed and data indicating the target attitude are applied, and the drive means are energized by energizing data based on the provided data, comprising:

detecting first attitude data that indicate the attitude to be induced in the control object when the drive means are energized and second attitude data indicating the actual attitude of the control object, obtaining disturbance data indicating disturbance from the differential between the first attitude data and the second attitude data, and compensating the energizing data used to energize the drive means on the basis of the disturbance data.

10. An attitude control method according to claim 9 wherein intensity data indicating the intensity of the energizing force actually applied to the drive means are detected and the energizing data compensated accordingly.

11. An attitude control method in which drive means are linked to a control object the prescribed attitude of which can be changed and data indicating the target attitude are applied, and the drive means are energized by energizing data based on the provided data, comprising:

when the drive means are energized, detecting first update rate data that indicate the attitude update rate for the energization to produce the intended attitude in the control object and second update rate data indicating the actual attitude update rate, and compensating the energizing data used to energize the drive means on the basis of first disturbance data obtained from the differential between the first and second update rate data obtained from the differential between the first update rate data and the second update rate data.

12. An attitude control method according to claim 11 wherein intensity data indicating the intensity of the energization actually applied to the drive means are detected and the energizing data are compensated accordingly.

13. An attitude control method in which drive means are linked to a control object the prescribed attitude of which can be changed and data indicating the target attitude are applied, and the drive means are energized by energizing data based on the provided data, comprising:

detecting first attitude data that indicate the attitude to be induced in the control object when the drive means are energized, first update rate data that indicate the attitude update rate, second attitude data indicating the actual attitude of the control object, and second update rate data indicating the [actual] attitude update rate, obtaining first disturbance data from the differential between the first attitude data and the second attitude data and second disturbance data from the differential between the first update rate data and the second update rate data, and compensating the energizing data used to energize the drive means on the basis of the first and second disturbance data.

14. An attitude control method according to claim 13 wherein intensity data indicating the intensity of the energization actually applied to the drive means are detected and the energizing data are compensated accordingly.

* * * * *